United States Patent [19]

Nishikawa et al.

[11] Patent Number: 4,960,689

[45] Date of Patent: Oct. 2, 1990

[54] COLOR PHOTOGRAPHIC LIGHT-SENSITIVE MATERIAL AND METHOD OF DEVELOPING THE SAME

[75] Inventors: Toshihiro Nishikawa; Shunji Takada; Kazunori Hasebe, all of Ashigara, Japan

[73] Assignee: Fuji Photo Film Co., Ltd., Ashigara, Japan

[21] Appl. No.: 201,406

[22] Filed: Jun. 2, 1988

[30] Foreign Application Priority Data

Jun. 5, 1987 [JP] Japan ..... 62-139983

[51] Int. Cl.[5] ..... G03C 1/035; G03C 1/09; G03C 1/34

[52] U.S. Cl. ..... 430/603; 430/605; 430/611; 430/551; 430/567; 430/583; 430/588; 430/592

[58] Field of Search ..... 430/605, 603, 611, 567, 430/551, 569, 583, 588, 592

[56] References Cited

U.S. PATENT DOCUMENTS

| | | | |
|---|---|---|---|
| 3,713,828 | 1/1973 | Hayashi et al. . | |
| 3,753,719 | 8/1973 | Sakamoto et al. . | |
| 3,935,016 | 1/1976 | Nishimura et al. . | |
| 4,173,483 | 11/1979 | Habu et al. | 430/603 |
| 4,198,240 | 4/1980 | Mikawa | 430/570 |
| 4,276,374 | 6/1981 | Mifune et al. | 430/611 |
| 4,288,535 | 9/1981 | Kanisawa et al. | 430/569 |
| 4,469,783 | 9/1984 | Kuwabara et al. | 430/567 |
| 4,472,496 | 9/1984 | Tanaka et al. | 430/542 |
| 4,666,826 | 5/1987 | Takada et al. . | |
| 4,729,946 | 3/1988 | Kasama et al. | 430/567 |
| 4,788,133 | 11/1988 | Sauerteig et al. | 430/505 |

FOREIGN PATENT DOCUMENTS

| | | |
|---|---|---|
| 0159912 | 10/1985 | European Pat. Off. . |
| 2043943 | 3/1971 | Fed. Rep. of Germany . |
| 2113199 | 10/1971 | Fed. Rep. of Germany . |
| 2225772 | 11/1974 | France . |
| A2023299 | 12/1979 | United Kingdom . |
| 1569758 | 6/1980 | United Kingdom . |

OTHER PUBLICATIONS

Patent Abstracts of Japan, vol. 7, No. 23; Silver Halide Photographic Material, Masao Ishikawa; 1983.

Patent Abstracts of Japan; vol. 10, No. 84; Silver Halide Photo Sensitive Material: K. Kadowaki; 1986.

Patent Abstracts of Japan, vol. 11; No. 334, Silver Halide Color Photographic Sensitive Material: K. Waki; 1987.

Patent Abstracts of Japan; vol. 6, No. 156; Formation of Negative Image; H. Sakamoto; 1982.

*Primary Examiner*—Paul R. Michl

*Assistant Examiner*—Mark R. Buscher

*Attorney, Agent, or Firm*—Burns, Doane, Swecker & Mathis

[57] ABSTRACT

A silver halide color photographic light-sensitive material includes a support having thereon at least one silver halide emulsion layer, wherein the emulsion layer contains a silver halide emulsion which comprises silver halide grains consisting of at least 50 mol % of silver chloride and contains at least one of the compounds represented by formulas [I] to [III]:

wherein Z represents alkyl (the number of carbon atoms is 1 to 18), aryl (the number of carbon atom is 6 to 18), or heterocyclic, Y represents an atom group required for forming heterocyclic or aryl (the number of carbon atoms of the aryl is 6 to 18), M represents metal cation, organic cation, or hydrogen atom, and n represents an integer from 2 to 10.

A silver halide color photographic light-sensitve material includes a support having thereon at least one silver halide emulsion layer, wherein the emulsion layer contains a silver halide emulsion which comprises silver grains consisting of at least 50 mol % of a chloride and chemically sensitized in the presence of at least one of the compounds represented by formulas [I] to [III].

A method of developing a silver halide color photographic light-sensitive material comprising a support having thereon at least one silver halide emulsion layer, characterized in that said emulsion layer contains a silver halide emulsion which comprises silver halide grains consisting of at least 50 mol % of silver chloride and contains at least one of the compounds represented by formulas [I] to [III], and that the method comprises the steps of: color-developing the silver halide color photographic light-sensitive material in the presence of a color coupler; and desilverizing the silver halide color photographic light-sensitive material.

5 Claims, No Drawings

COLOR PHOTOGRAPHIC LIGHT-SENSITIVE MATERIAL AND METHOD OF DEVELOPING THE SAME

BACKGROUND OF THE INVENTION

1. Field of the Invention

The present invention relates to a color photographic light-sensitive material containing a novel silver halide emulsion, and a method of developing the same.

2. Description of the Related Art

Various silver halide photographic light-sensitive materials are put into practical use by utilizing the fact that silver halide crystal grains are sensitive to a radiation such as visible light or ultraviolet rays, to form a latent image which is subsequently converted into a visible image by development. Examples of silver halide are silver iodide, silver bromide, silver chloride, and their mixed crystals. In this case, a silver halide to be used is selected in accordance with the application and the required function of a light-sensitive material in which the silver halide is used. For example, silver iodobromide grains having a relatively large grain size are used in a light-sensitive photographic material which is required to have high sensitivity. In contrast, silver iodobromide or silver chlorobromide having a small grain size is used in a duplicating or printing light-sensitive material having relatively low sensitivity. The type of silver halide, the crystal shape, grain size, and the like are all important factors in determining the properties of a given silver halide emulsion. This is described in, for example, "The Theory of the Photographic Process" by T. H. James, 4th. ed., Macmillan Co. Ltd. New York, 1977, "Die Grundlagen der Photographischen Prozesse mit Silverhalogeniden" by C. Hasse, H. Frieser, and E. Klein, Akademische Verlagsgesellschaft, Frankfurt an Main, 1968.

In recent years, the time required for printing and developing photographic materials for prints has been greatly reduced. Therefore, a strong demand has increasingly arisen for a light-sensitive material which has high sensitivity and can be stably processed. Conventionally, a silver chlorobromide emulsion subjected to sulfur sensitization is practically used as a photographic material for prints. However, use of such an emulsion does not permit a reduction in developing time, since development is restrained significantly by the release of bromide ions during the development process. In addition, since these ions gradually accumulate in the processing liquid, variations in the photographic characteristics increase over time. Furthermore, since the silver chlorobromide emulsion has low solubility in water, the fixing time is necessarily long. A high silver chloride emulsion having a high silver chloride content and containing substantially no silver iodide is known as a preferable material for reducing the time required for the development, bleaching, and fixing steps and for minimizing changes in photographic characteristics, as caused by variations in the processing conditions. In a high silver chloride emulsion, cubic grains having a (100) crystal plane are normally formed. However, when these grains are chemically sensitized, they tend to cause fog. Such fog is significant especially when the grains are subjected to gold sensitization. More specifically, fog poses a practical problem in a color developer having high activity for rapid development. Storage fog generated when a light-sensitive material is stored also poses a practical problem. When a high silver chloride emulsion is exposed at high intensity for a short period of time, reciprocity failure is increased. This is another drawback of the high silver chloride emulsion when it is used as a material for prints.

Several methods have been proposed to solve these problems associated with high silver chloride emulsion. Hereinafter, the symbol "JP-A-" will be used to denote a Japanese Patent Disclosure, and the symbol "JP-B-" will be used to designate a Japanese Patent Publication. Further, the symbol "JP-A-(examined)" will be used to specify a published Japanese patent application without having been laid open which was filed before Jan. 1, 1971 when the system of laying open any patent application came into existence. JP-A-48-51627 and JP-A(examined)-49-46932 describe methods in which water-soluble bromide or iodide ions are added after a sensitizing dye is added to a silver halide emulsion, while JP-A-58-108533 and JP-A-60-222845 describe methods in which bromide and silver ions are simultaneously added to silver halide grains having a high silver chloride content, to form layers containing 60 mol % or more of silver bromide on grain surfaces. In a similar method, a layer containing 10 to 50 mol % of silver bromide is formed on part of, or the entire surface of each grain. In still another method proposed, as described in JP-B-50-36978, JP-B-58-24772, U.S. Pat. No. 4,471,050, and West German Patent Application (OLS) No. 3,229,999, bromide ions are added to a silver halide having a high silver chloride content, or else bromide and silver ions are simultaneously added thereto, to perform halide conversion to obtain multilayer grains such as double-structured (i.e., a core and a shell) grains or joint-structured grains. However, these conventional methods do not provide a satisfactory sensitivity level and the like.

One method of chemically sensitizing an emulsion having a high silver chloride content is sulfur sensitization in the presence of a solvent for silver halide, this method being described in JP-A-58-30748. According to another chemical sensitization method, as described in JP-A-58 125612, pAg and/or temperatures during sulfur sensitization are controlled in a two-step manner. However, neither of these methods can provide a sensitivity high enough to permit their end products to be used as photographic light-sensitive materials.

Compounds represented by formulas [I] to [III] presented later are known as antifoggants. U.S. Pat. Nos. 2,394,198 and 2,440,206, for example, disclose the compounds as an antifoggant used when a sulfinic acid compound is used; U.S. Pat. No. 3,047,393 discloses the compounds as an antifoggant for a silver iodobromide; JP-A(examined)-39-25774 discloses that the compounds can be used to stabilize a silver image; JP-A(examined)-42-11305 discloses that the compounds can be used together with a tetraazaindene compound to prevent fog of a silver iodobromide emulsion; JP-A-54-1019 (corresponding to British Patent No. 1,569,758) discloses that the compounds can be used to prevent fog of a silver iodobromide emulsion when an organic thioether compound is used; and JP-A-57-176032 discloses that the compounds can be used together with a cyanine dye and an anti-oxidizing agent to improve latent image fading of a silver iodobromide emulsion. No disclosure, however, has been reported in which the compounds represented by formulas [I] to [III] are applied to a high silver chloride emulsion. In addition, it is very difficult to predict whether or not, or how much the compounds function to prevent fog and to achieve other photographic effects when they are added to a high silver chloride emulsion having a halogen composition different from that of the conventional emulsion.

As is well known, a high silver chloride emulsion is a preferable material for reducing the time required for the developing process. This emulsion can be chemically sensitized to have a sufficient sensitivity. If it is so sensitized, and used in a material for color prints, it will cause fog. The sensitized emulsion has a high-intensity reciprocity failure. Thus, it has been considered to be unadvisable to manufacture a color printing material using a high silver chloride emulsion. It is also known in the art that emulsions will generally cause fog if they are gold-sensitized. Hitherto, no technique has been developed which makes it possible to provide a high silver chloride emulsion that is sensitized greatly enough not to cause an excessive fog even if it has been subjected to gold-plus-sulfur sensitization. It has been demanded that such a technique be developed.

SUMMARY OF THE INVENTION

It is, therefore, a first object of the present invention to provide a silver halide color photographic light-sensitive material having low fog and high photographic sensitivity and which can be rapidly developed.

It is a second object of the present invention to provide a silver halide color photographic light-sensitive material with high sensitivity and a small reciprocity failure and storage fog.

It is a third object of the present invention to provide a color photographic light-sensitive material which retains its constant quality even when color development, and desilverizing including bleaching and fixing are rapidly and continuously performed.

It is still another object of the present invention to provide a method of developing a silver halide color photographic light sensitive material in which fog is reduced and a constant image quality can be obtained.

It is still another object of the present invention to provide a developing method in which a developing time can be reduced to less than two minutes and which can be used for various purposes.

Other objects of the present invention will be apparent from the following description.

As a result of extensive studies, the present inventors have found that the above objects can be achieved by the following silver halide color photographic light-sensitive materials and methods of developing the same.

1. A silver halide color photographic light-sensitive material comprising a support having thereon at least one silver halide emulsion layer, characterized in that the emulsion layer contains a silver halide emulsion which comprises silver halide grains consisting of at least 50 mol % of silver chloride and contains at least one of the compounds represented by formulas [I]to [III]:

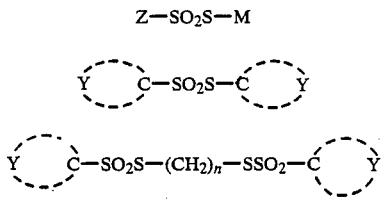

wherein z represents alkyl (the number of carbon atoms is 1 to 18), aryl (the number of carbon atoms is 6 to 18), or heterocyclic, Y represents an atom group required for forming a heterocyclic or aryl ((the number of carbon atoms of the aryl is 6 to 18), M represents a metal cation, an organic cation, or a hydrogen atom, and n represents an integer from 2 to 10.

2. A silver halide color photographic light-sensitive material comprising a support having thereon at least one silver halide emulsion layer, characterized in that the emulsion layer contains a silver halide emulsion which comprises silver halide grains consisting of at least 50 mol % of silver chloride and chemically sensitized in the presence of at least one of the compounds represented by formulas [I]to [III].

3. The material as described in item 2, wherein the emulsion layer contains a silver halide emulsion comprising silver halide grains consisting of at least 50 mol % of silver chloride and gold-sensitized in the presence of at least one of the compounds represented by formulas [I]to [III].

4. The material as described in item 2, wherein the emulsion contains a silver halide emulsion comprising silver halide grains consisting of at least 50 mol % of silver chloride and gold-plus-sulfur-sensitized in the presence of at least one of the compounds represented by formulas [I]to [III].

5. A method of developing a silver halide color photographic light-sensitive material comprising a support having thereon at least one silver halide emulsion layer, characterized in that the emulsion layer contains a silver halide emulsion which comprises silver halide grains consisting of at least 50 mol % of silver chloride and contains at least one of the compounds represented by formulas [I]to [III], and that the method comprises the steps of: color-developing the silver halide color photographic light-sensitive material in the presence of a color coupler; and desilverizing the silver halide color photographic light sensitive material.

6. The method as described in item 5, wherein the color coupler is a nondiffusible color coupler contained in the photographic light-sensitive material.

The present invention will be described in detail below.

(1) Silver Halide Emulsion 1-1. Silver Halide Emulsion Grains

The emulsion of this invention is a silver halide emulsion substantially not containing silver iodide. In this case, an expression "substantially not containing silver iodide" means that a molar content of silver iodide is 2 mol % or less, preferably, 1 mol % or less, and more preferably, 0.1 mol % or less.

At least 50% of the emulsion of this invention is a silver chloride. A chloride content, i.e., a molar content of silver chloride is preferably 75 mol % or more, more preferably, 90 mol % or more, and most preferably, 95 mol % or more.

The remaining halide components of the emulsion grains of this invention are bromide and iodide (contents of which are defined above), and a bromide is preferred.

The emulsion grains of this invention may have a uniform inner crystal structure, a structure in which a halide composition of an inner portion differs from that of an outer portion, or a layer structure of three or more layers. In addition, silver halides having different compositions may be bonded by an epitaxial junction.

In the emulsion grains of this invention, it is preferred that a layer containing a large amount of silver bromide is locally present on the surface or the vicinity of the surface of the grains. In the case of core/shell type grains, a silver chloride content of a core portion is preferably higher than that of a shell portion. The layer having a large amount of silver bromide present on the surface or the vicinity of the surface of the grains may be formed by a so-called conversion method, i.e., by conversion of bromide ions into silver chloride.

An average halide composition of each silver halide grain can be measured using an electron beam microanalyzer. This EPMA method is described in, e.g., JP-A-60-143332.

Although an average grain size of the silver halide grains of this invention is not limited, it is preferably 0.1 $\mu$ to 5 $\mu$, and more preferably, 0.2 $\mu$ to 3 $\mu$. A grain size distribution of the silver halide grains of this invention may be either multi-dispersion or monodispersion, but mono-dispersion is preferable.

The silver halide emulsion of this invention may be of either an internally sensitive emulsion or a surface sensitive emulsion. The silver halide emulsion of this invention is a negative type.

The emulsion of the present invention may contain silver halide grains having any crystal habit. An emulsion having cubic, tetradecahedral, or octahedral regular crystal grains is more preferable in the present invention than that having spherical or tabular grains. A method of forming preferable octahedral grains is described in detail in, e.g., U.S. Ser. No. 162,554 filed on Mar. 1, 1988 by the present inventors.

In general, as silver halide grains having a high silver chloride content (to be referred to as "high silver chloride grains" hereinafter), only cubic grains consisting of the (100) crystal plane can be obtained. However, octahedral grains consisting of the (111) crystal plane can be obtained by some improvements as described in, in addition to the above patent application filed by the present inventors, Cleas et al.; The Journal Photographic Science, Vol. 21, 39 (1973) and Wyrsch; International Congress of Photographic Science, III-13, 122 (1978).

In the former reference, a compound, e.g., adenine, dimethylthiourea, or thiourea is used. Considering a structure of a compound, a compound such as adenine has a relatively high adsorption tendency to a silver halide or tends to generate fog due to unstable sulfur molecules.

In the latter reference, octahedral silver chloride grains are obtained by ammonia and a large amount of cadmium nitrate. However, cadmium poses a practical problem of environmental pollution.

Since high silver chloride grains tend to generate fog, use of ammonia is not preferable. That is, it is preferable that the high silver chloride octahedral grains can be prepared without ammonia.

JP-A-55-26589 discloses a method of preparing octahedral grains using a merocyanine dye. In this method, since dye adsorption is strong, preferable photographic characteristics can be obtained. However, only a specific dye structure can form an octahedron. Therefore, in preparation of blue-, green-, and red-sensitive emulsions, it is often difficult to give an absorption peak to a specific wavelength or to control a shape of spectral sensitivity for a specific application.

In this invention, the chloride concentration during grain formation is preferably 5 mol/l or less, and more preferably, 0.07 to 3 mol/l. A temperature during grain formation is 10° to 95° C., and preferably, 40° to 90° C. A pH during grain formation is not limited but preferably falls within the neutral to weakly acidic range.

In preparation of the silver halide grains of this invention, a solvent for silver halide may be used.

Examples of the solvent for silver halide are thiocyanate, thioether, and thioureas. Also, ammonia can be used as long as it does not adversely affect grain formation.

Examples are thiocyanate (e.g., U.S. Pat. Nos. 2,222,264, 2,448,534, and 3,320,069), thioether compound (e.g., U.S. Pat. Nos. 3,271,157, 3,574,628, 3,704,130, 4,297,439, and 4,276,347), thion compound (e.g., JP-A-53-144319, 53-82408, and JP-A-55-77737), and amine compound (e.g., JP-A-54-100717).

During formation or physical ripening of the silver halide grains, cadmium salt, zinc salt, lead salt, thallium salt, iridium salt or its complex salt, rhodium salt or its complex salt, or iron salt or its complex salt may be used. Especially, iridium salt or rhodium salt is preferable.

In the manufacture of the silver halide grains of this invention, an addition rate, an addition amount, and an addition concentration of a silver salt solution (e.g., an aqueous $AgNO_3$ solution) and a halide solution (e.g., an aqueous NaCl solution) added to increase grain growth are preferably increased.

Examples of this method are described in British Patent No. 1,335,925, U.S. Pat. No. 3,672,900, JP-A-3,650,757, U.S. Pat. No. 4,242,445, JP-A-55-142329, JP-A-55-158124, JP-A-58-113927, JP-A-58-113928, JP-A-58 111934, and JP-A-58-111936.

1-2. Chemical Sensitization

The crystal silver halide emulsion of this invention can be chemically sensitized, if necessary, although it can be used without chemical sensitization.

Chemical sensitization methods which can be used are a gold sensitization method using a gold compound (e.g., U.S. Pat. Nos. 2,448,060 and 3,320,069), a sensitization method using a metal such as iridium, platinum, rhodium, or palladium (e.g., U.S. Pat. Nos. 2,448,060, 2,556,245, and 2,566,263), a sulfur sensitization method using a sulfur-containing compound (e.g., U.S. Pat. No. 2,222,264), a selenium sensitization method using a selenium compound, a reduction sensitization method using a stannate, thiourea dioxide, or polyamine (e.g., U.S. Pat. Nos. 2,487,850, 2,518,698, and 2,521,925), or a combination of at least two methods described above.

As for the silver halide grains of this invention, gold sensitization, a combination of gold sensitization and sulfur sensitization, or a combination of gold sensitization and reduction sensitization is preferable, and gold-plus-sulfur sensitization is most preferable.

The amount of the gold sensitizer is preferably $1\times10^{-7}$ mol or more and more preferably $1\times10^{-6}$ mil or more per mol of the silver halide. The amount of the sulfur sensitizer used together with the gold sensitizer can be properly selected in accordance with conditions such as a grain size, a chemical sensitization temperature, pAg, and pH and is $1\times10^{-7}$ to $10^{-3}$ mol, preferably $5\times10^{-7}$ to $10^{-4}$ mol, and more preferably $5\times10^{-7}$ to $10^{-5}$ mol per mol of the silver halide.

Conditions such as a pH, a pAg, a temperature, a time, additives, and the like for a chemical ripening step in the present invention are not limited. That is, the chemical ripening step can be performed under the conditions generally used in the field of the invention.

For example, the pH is preferably 3.0 to 8.5, and more preferably, 5.0 to 7.5, the pAg is preferably 5.0 to 9.0, and more preferably, 5.5 to 7.5, the temperature is preferably 40° to 85° C., and more preferably, 45° C. to 75° C., and the time is preferably 10 to 200 minutes, and more preferably, 30 to 120 minutes.

Examples of a preferable gold sensitizer are compounds described in U.S. Pat. Nos. 2,399,083, 2,540,085, 2,540,086, and 2,597,856. More specifically, examples are chloroauric acid and its salts, potassium gold cyanide, potassium gold thiocyanide, and gold sulfide. As described on page 155 of the above reference of James, a gold sensitization effect can be effectively enhanced using a thiocyanate. In addition, a 4-substituted thiourea compound can be effectively used as described in JP-B-59-11892.

Examples of a sulfur sensitizer used in the present invention are thiosulfates, thioureas, thiazoles, rhodanines, and other compounds described in U.S. Pat. Nos. 1,574,944, 2,410,689, 2,728,668, and 3,656,955. In addition, a sulfur-containing compound and the like described in U.S. Pat. Nos. 3,857,711, 4,266,018, and 4,054,457 can be used.

The present invention is characterized in that an increase in fog, especially when a gold sensitizer is used, can be prevented by adding at least one of the compounds represented by formulas [I] to [III]. The compound may be added in a grain formation step, a desalting step, a chemical ripening step, or immediately before coating. It is preferable to add the compounds in the grain formation, desalting, or chemical ripening step. If a gold sensitizer is used it is preferable to add the compound before the gold sensitizer is added. In a preferred embodiment of the present invention, the silver halide color photographic light-sensitive material contains a silver halide emulsion chemically sensitized in the presence of at least one of compounds represented by formulas [I] to [III]. The chemical sensitization is preferably performed by gold sensitization and more preferably gold-plus-sulfur sensitization.

The compound represented by formula [I], [II], or [III] will be described below.

Alkyl, aryl, and heterocyclic represented by Z and Y in formulas [I], [II], and [III] may be substituted.

Examples of a substituent group are lower alkyl such as methyl and ethyl, aryl such as phenyl, alkoxyl having 1 to 8 carbon atoms, halogen such as chlorine, nitro, amino, and carboxyl.

The number of carbon atoms of alkyl represented by Z is 1 to 18, and the number of carbon atoms of aryl represented by Z and Y is 6 to 18.

Examples of the heterocyclic ring represented by Z and Y are thiazole, benzthiazole, imidazole, benzimidazole, and oxazole.

Preferable examples of the metal cations represented by M are alkali metal cations such as sodium ions and potassium ions and organic cations such as ammonium ions and guanidinium ions.

n represents an integer from 2 to 10.

Examples of the compound represented by formula [I], [II], or [III] are listed in Table 1 below.

TABLE 1

| | |
|---|---|
| a | 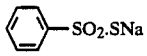 |

TABLE 1-continued

| | |
|---|---|
| b | 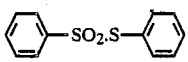 |
| c | 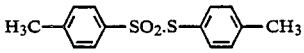 |
| d | 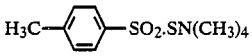 |
| e | $H_3C.SO_2.SNa$ |
| f | 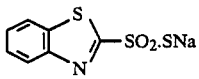 |
| g | 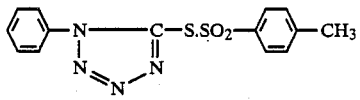 |
| h | 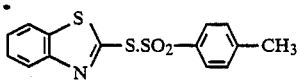 |
| i | 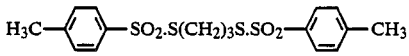 |
| j | 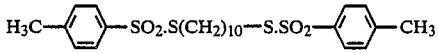 |
| k | L-cystine-disulfoxide |
| l | 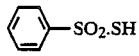 |

The compound represented by formula [I], [II], or [III] can be synthesized by a method well known to those skilled in the art.

For example, the compound can be synthesized by causing a corresponding sulfonyl fluoride to react with a sodium sulfide or by causing a corresponding sodium sulfinate to react with sulfur. Alternatively, these compounds are commercially available and therefore can be easily obtained.

In the present invention, the content of the compound represented by formula [I], [II], or [III] is $10^{-2}$ mol or less, preferably, $10^{-}$to $3\times10^{-3}$ mol, and more preferably, $10^{-7}$ to $10^{-3}$ mol per mol of the silver halide.

1-3. Spectral Sensitization

The silver halide emulsion of this invention may be spectrally sensitized by methine dyes or the like. Examples of the dye are cyanine dye, merocyanine dye, complex cyanine dye, complex merocyanine dye, holopolar cyanine dye, hemicyanine dye, styryl dye, and hemioxonole dye. Most effective dyes are those belonging to cyanine dye, merocyanine dye, and complex merocyanine dye. Any nucleus normally used in the cyanine dye or the like as a basic heterocyclic ring nucleus can be used in these dyes. Examples of the nucleus are pyrroline, oxazoline, thiazoline, pyrrole, oxazole, thiazole, selenazole, imidazole, tetrazole, and pyridine; nuclei obtained by condensed alicyclic hydrocarbon ring to the above nuclei; and nuclei obtained by condensed aromatic hydrocarbon ring to the above nuclei, i.e., indolenine, benzindolenine, indole, benzoxadole, naphthoxazole, benzothiazole, naphtothiazole, benzoselenazole, benzimidazole, and quinoline. These nuclei may be substituted on a carbon atom.

Examples of a nucleus used in the merocyanine dye or the complex merocyanine dye are 5- and 6-membered ring nuclei having a ketomethylene structure such as a pyrazoline-5-one, thiohydantoin, 2-thiooxazolidine-2,4-dione, thiazolidine-2,4-dione, rhodanin and thiobarbituric acid.

For example, the compounds described in Research Disclosure, Item 17643, Page 23, Section IV (December 1978) or the compounds described in the references cited therein can be used.

A typical example is the following methine dye.

Formula [XXa]

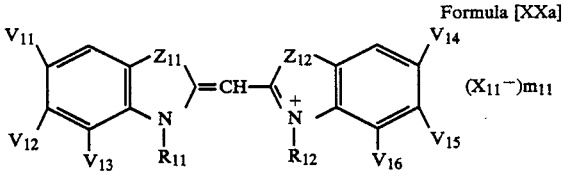

In the above formula, $Z_{11}$ represents oxygen, sulfur, or selenium and $Z_{12}$ represents sulfur or selenium.

$R_{11}$ and $R_{12}$ each represent alkyl or alkenyl which has six carbon atoms or less and may be substituted. At least one of $R_{11}$ or $R_{12}$ represents sulfo-substituted alkyl, and most preferably, at least one of them represents 3-sulfopropyl, 2-hydroxy-3-sulfopropyl, 3-sulfobutyl, or sulfoethyl. Examples of a substituting group are alkoxy having four carbon atoms or less, halogen, hydroxyl, and carbamoyl, phenyl which have eight carbon atoms or less and may be substituted, carboxy, and sulfo and alkoxycarbonyl having five carbon atoms or less. Examples represented by $R_{11}$ and $R_{12}$ are methyl, ethyl, propyl, allyl, pentyl, hexyl, methoxyethyl, ethoxyethyl, phenethyl, 2-p-tolylethyl, 2-p-sulfophenethyl, 2,2,2-trifluoroethyl, 2,2,3,3-tetrafluoropropyl, carbamoylethyl, hydroxyethyl, 2-(2-hydroxyethyl)ethyl, carboxymethyl, carboxyethyl, ethoxycarbonylmethyl, 2-sulfoethyl, 2-chloro-3-sulfopropyl, 3-sulfopropyl, 2-hydroxy-3-sulfopropyl, and 3- or 4-sulfobutyl.

When $Z_{11}$ represents oxygen, $V_{11}$ and $V_{13}$ represent hydrogen, and $V_{12}$ represents phenyl, alkyl having 3 carbon atoms or less or alkoxy having 3 carbon atoms or less or phenyl substituted by chlorine (more preferably, $V_{12}$ is phenyl), and also represents that $V_{11}$ and $V_{12}$, or $V_{12}$ and $V_{13}$ can be coupled to form a condensed benzene ring. Most preferably, $V_{11}$ and $V_{13}$ represent hydrogen, and $V_{12}$ represent phenyl.

When $Z_{11}$ represents sulfur or selenium, $V_{11}$ represents alkyl or alkoxy each having four carbon atoms or less, or hydrogen, $V_{12}$ represents alkyl having five carbon atoms or less, alkoxy having four carbon atoms or less, chlorine, hydrogen, phenyl which may be substituted (e.g., tolyl, anisyl, and phenyl) or hydroxyl, and $V_{13}$ represents hydrogen and also represents that $V_{11}$ and $V_{12}$, or $V_{12}$ and $V_{13}$ can be coupled to form a condensed benzene ring. More preferably, $V_{11}$ and $V_{13}$ represent hydrogen and $V_{12}$ represents alkoxy having four carbon atoms or less, phenyl, or chlorine; $V_{11}$ represents alkoxy or alkyl, each having four carbon atoms or less and $V_{12}$ represents hydroxyl or alkyl having four carbon atoms or less; or $V_{12}$ and $V_{13}$ are coupled to form a condensed benzene ring.

When $Z_{12}$ represents selenium, $V_{14}$, $V_{15}$, and $V_{16}$ represent the same meanings as those represented by $V_{11}$, $V_{12}$, and $V_{13}$ when $Z_{11}$ represents selenium, respectively. When, $Z_{12}$ represents sulfur and $Z_{11}$ represents selenium, $V_{14}$ represents hydrogen, alkoxy having four carbon atoms or less, or alkyl having five carbon atoms or less, $V_{15}$ represents alkoxy having four carbon atoms or less, phenyl which may be substituted (preferably phenyl) such as tolyl or anisyl, alky having four carbon atoms or less, chlorine, or hydroxyl, and $V_{16}$ represents hydrogen and also represents that $V_{14}$ and $V_{15}$ or VI5 and $V_{16}$ can be coupled to form a condensed benzene ring. More preferably, $V_{14}$ and $V_{16}$ represent hydrogen, $V_{15}$ represents alkoxy having four carbon atoms or less, chlorine, or phenyl, and $V_{15}$ and $V_{16}$ are coupled to form a condensed benzene ring. When both $Z_{11}$ and $Z_{12}$ represent sulfur, $V_{14}$ and $V_{16}$ represent hydrogen, $V_{15}$ represents phenyl which may be substituted (e.g., phenyl and tolyl), and $V_{14}$ represents hydrogen and also represents that $V_{15}$ and $V_{16}$ can be coupled to form a condensed benzene ring. When $Z_{11}$ represents oxygen and $Z_{12}$ represents sulfur, $V_{14}$ and $V_{16}$ represent hydrogen, and $V_{15}$ represents chlorine, phenyl which may be substituted, or alkoxy having four carbon atoms or less and also represents that $V_{15}$ and $V_{16}$ can be coupled to form a condensed benzene ring. More preferably, $V_{14}$ and $V_{16}$ represent hydrogen and $V_{15}$ represents phenyl, or $V_{15}$ and $V_{16}$ are coupled to represent a condensed benzene ring.

$X_{11}^-$ represents anion residue of acid.

$m_{11}$ represents 0 or 1, and in the case of an inner salt, represents 1.

Formula [XXb]

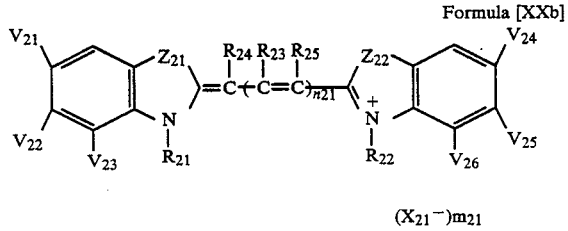

In the above formula, $Z_{21}$ and $Z_{22}$ may be the same or different and represent oxygen, sulfur, selenium, or $>N\text{-}R_{26}$.

$R_{21}$ and $R_{22}$ represent the same meanings as those represented by $R_{11}$ and $R_{12}$ of formula XXa, and also represent that $R_{21}$ and $R_{24}$ or $R_{22}$ and $R_{25}$ can be coupled to form a 5- or 6-membered carbon ring. When $n_{21}$ represents 2 or 3, $R_{21}$ and $R_{22}$ do not represent a substituting group having sulfo at the same time.

When at least one of $Z_{21}$ and $Z_{22}$ represents $>N\text{-}R_{26}$, $R_{23}$ represents hydrogen, and otherwise, represents lower alkyl or phenethyl (more preferably ethyl). When $n_{21}$ represents 2 or 3, $R_{23}$ represents that different $R_{23}$ and $R_{23}$ can be coupled to form a 5- or 6-membered ring.

$R_{24}$ and $R_{25}$ represent hydrogen.

$R_{26}$ and $R_{27}$ represent the same meanings as that represented by $R_{21}$ or $R_{22}$ and also represent that $R_{21}$ $R_{26}$ do not represent a substituting group having sulfo at the same time and that $R_{22}$ and $R_{26}$ represent a substituting group having sulfo at the same time.

When $Z_{21}$ represents oxygen, $V_{21}$ represents hydrogen. When $Z_{21}$ represents sulfur or selenium, $V_{21}$ represents hydrogen, or an alkyl or alkoxy, each having five carbon atoms or less. When $Z_{21}$ represents $>N-R_{26}$, $V_{21}$ represents hydrogen or chlorine.

When $Z_{21}$ represents oxygen and $Z_{22}$ represents $>N-R_{27}$, $V_{22}$ represents hydrogen, alkyl or alkoxy, each having five carbon atoms or less, chlorine, or phenyl which may be substituted (e.g., tolyl, anisyl, or phenyl) and also represents that $V_{22}$ can be coupled to $V_{21}$ or $V_{23}$ to form a condensed benzene ring (more preferably, $V_{22}$ represents alkoxy or phenyl, or $V_{21}$ and $V_{22}$ or $V_{22}$ and $V_{23}$ are coupled to form a condensed benzene ring). When $Z_{21}$ and $Z_{22}$ mainly represent oxygen, $V_{22}$ represents phenyl which may be substituted (e.g., tolyl, anisyl, or phenyl, and more preferably, phenyl) or represents that $V_{22}$ can be coupled to $V_{21}$ or $V_{23}$ to form a condensed benzene ring. When $Z_{21}$ represents alkoxycarbonyl, each having five carbon atoms or less, alkoxy or acylamino, each having four carbon atoms or less, chlorine, or phenyl which may be substituted (more preferably, alkyl or alkoxy, each having four carbon atoms or less, chlorine, or phenyl) and also represents that $V_{22}$ can be coupled to $V_{23}$ to form a condensed benzene ring. When $Z_{21}$ represents $>N-R_{26}$, $V_{22}$ represents chlorine, trifluoromethyl, cyano, alkylsulfonyl having four carbon atoms or less, or alkoxycarbonyl having five carbon atoms or less (more preferably, when $Z_{21}$ represents $>N-R_{26}$, $V_{21}$ represents chlorine, and $V_{22}$ represents chlorine, trifluoromethyl, or cyano).

$V_{23}$ represents hydrogen.

$V_{24}$ represents the same meaning as that represented by $V_{21}$ when $Z_{22}$ represents an atom type corresponding to that represented by $Z_{21}$.

When $Z_{22}$ represents oxygen, $V_{25}$ represents alkoxy having four carbon atoms or less, chlorine, or phenyl which may be substituted (e.g., anisyl, tolyl, or phenyl) or represents that $V_{25}$ can be coupled to $V_{24}$ or $V_{26}$ to form a condensed benzene ring. When $Z_{21}$ represents $>N-R_{26}$, $V_{25}$ preferably represents alkoxy having four carbon atoms or less or phenyl or represents that $V_{25}$ can be coupled to $V_{24}$ or $V_{26}$ to form a condensed benzene ring. When $Z_{21}$ represents oxygen, sulfur, or selenium, $V_{25}$ preferably represents phenyl or represents that $V_{25}$ can be coupled to $V_{24}$ or $V_{26}$ to form a condensed benzene ring. When $Z_{22}$ represents $>N-R_{26}$, $V_{25}$ represents the same meaning as that represented by $V_{22}$ when $Z_{21}$ represents $>N-R_{26}$. When $Z_{22}$ represents sulfur or selenium, $V_{25}$ represents the same meaning as that represented by $V_{22}$ when $Z_{21}$ represents sulfur or selenium.

$V_{26}$ represents hydrogen.

$X_{21}^-$ represents anion residue of acid.

$m_{21}$ represents 0 or 1, and in the case of an inner salt, represents 0.

$n_{21}$ represents 1, 2, or 3.

Formula [XXc]

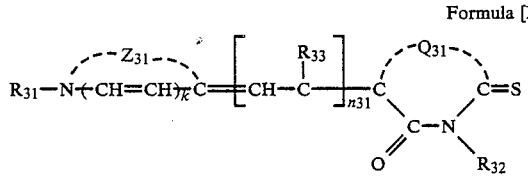

In formula XXc, $Z_{31}$ represents an atom group for forming nuclei such as thiazoline, thiazole, benzothiazole, naphtholthiazole, selenazoline, selenazole, benzoselenazole, naphthoselenazole, benzimidazole, naplthoimidazole, oxazole, benzoxazole, naphthooxazole, or pyridine. These heterocyclic nuclei may be substituted. In the case of benzimidazole or naphthomidazole, examples of a substituting group on nitrogen at the 1-position which is not $R_{31}$ are those listed as $R_{26}$ or $R_{27}$ of formula XXb. Examples of a substituting group on a condensed benzene ring of benzimidazole are chlorine, cyano, alkoxycarbonyl having five carbon atoms or less, alkylsulfonyl having four carbon atoms or less, or trifluoromethyl. Preferably, the 5-position is substituted by chlorine, and the 6-position is substituted by cyano, chlorine, or trifluoromethyl. Examples of a substituting group on heterocyclic nuclei other than benzimidazole, selenazoline, and thiazoline nuclei are alkyl having eight carbon atoms or less which may be substituted (examples of the substituting group are hydroxy, chlorine, fluorine, alkoxy, carboxy, alkoxycarbonyl, phenyl, and substituted phenyl), hydroxyl, alkoxycarbonyl having five carbon atoms or less, halogen, carboxy, furyl, thienyl, pyridyl, phenyl, or substituted phenyl (e.g., tolyl, anicyl, and chlorophenyl). Examples of a substituting group on a selenazoline or thiazoline nucleus are alkyl having six carbon atoms or less, hydroxyalkyl and alkoxycarbonylaklyl, each having five carbon atoms or less.

$R_{31}$ represents the same meaning as that represented by $R_{11}$ or $R_{12}$ of formula XXa.

$R_{32}$ represents the same meaning as that represented by $R_{11}$ or $R_{12}$ of formula XXa, and also represents hydrogen, furfuryl, or monocyclic aryl which may be substituted (e.g., phenyl, tolyl, anicyl, carboxyphenyl, hydroxyphenyl, chlorophenyl, sulfophenyl, pyridyl, 5-methyl-2-pyridyl, 5-chloro-2-pyridyl, thienyl, and furyl), and also represents that at least one of $R_{31}$ and $R_{32}$ is a substituting group having sulfo or carboxy and the other is a group not containing sulfo.

$R_{33}$ represents hydrogen, alkyl having five carbon atoms or less, phenethyl, phenyl, 2-carboxyphenyl, and when n represents 2 or 3, represents that different $R_{33}$ and $R_{33}$ can be coupled to form a 5- or 6-membered ring.

$Q_{31}$ represents oxygen, sulfur, selenium, or $>N-R_{34}$, and when $Z_{31}$ represents atom group for forming thiazoline, selenazoline, or oxazole nucleation, preferably represents sulfur, selenium, or $>N-R_{34}$.

$R_{34}$ represents hydrogen, pyridil, phenyl, substituted phenyl (e.g., tolyl and anicyl) or an aliphatic hydrocarbon group having eight carbon atoms or less which may contain oxygen, sulfur, or nitrogen in a carbon chain or may contain a substituting group such as hydroxyl, halogen, alkyl aminocarbonyl, alkoxycarbonyl, and phenyl, and more preferably, represents hydrogen, phenyl, pyridyl, or alkyl which may contain an oxygen atom in a carbon chain or may contain hydroxyl.

k represents 0 or 1, and $n_{31}$ represents 0, 1, 2, or 3.

Examples of a compound of a spectral sensitizing dye preferably used in the present invention are listed in Table 13 to be presented later.

Preferably, the silver halide grians in the photographic material of the present invention are spectrally sensitized by at least one of sensitizing dyes represented by formulas [XXa], [XXb] and [XXc].

A dye may be added in an emulsion at any timing conventionally known to be effective in emulsion preparation. Most ordinarily, the dye is added after chemical sensitization is completed and before coating is performed. However, as described in U.S. Pat. Nos. 3,628,969 and 4,225,666, the dye can be added at the same time a chemical sensitizing agent is added to simultaneously perform spectral sensitization and chemical sensitization. Also, the dye can be added prior to chemical sensitization as described in JP-A-58 113928, or can be added to start spectral sensitization before silver halide grain precipitation/generation is completed. Furthermore, as described in U.S. Pat. No. 4,225,666, these compounds can be added twice, i.e., some portions of the compounds can be partially added prior to chemical sensitization and the remaining portions of the compounds can be added thereafter. Thus, any timing during silver halide grain formation as described in U.S. Pat. No. 4,183,756 can be used.

The amount of the dye may be $1\times10^{-6}$ to $8\times10^{-3}$ $10^{-3}$ mol per mol of the silver halide. However, when a silver halide grain size is more preferable, i.e., 0.2 to 1.2 μm, about $5\times10^{-5}$ to $2\times10^{-3}$ mol is more effective.

1-4. Emulsion Additives

An antifoggant such as mercaptotriazoles, mercaptotetrazoles, or benzotriazoles can be used together with the silver halide emulsion.

For rapid development, the silver chlorobromide emulsion or the silver chloride emulsion is preferred. In addition, an antifoggant such as a mercapto compound, a nitrobenzotriazole compound, or a benzotriazole compound, which is strongly adsorbed in the silver halide, or a stabilizer is used. Furthermore, a normally used development promoting agent, an antihalation agent, an antiirradiation agent, and a phosphor bleach agent can be used.

The most preferable stabilizer used in the present invention is represented by formula [XXI], [XXII], or [XX1II].

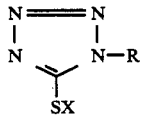

Formula [XXI]

wherein R represents alkyl, alkenyl, or aryl. X represents hydrogen, alkali metal, ammonium, or a precursor. Examples of the alkali metal are sodium and potassium, and examples of ammonium are tetramethylammonium and trimethylbenzyl ammonium. The precursor is a group which can be H or alkali metal under alkaline conditions. Examples of the precursor are acetyl, cyanoethyl, and methanesulfonylethyl.

Of the above Rs, alkyl and alkenyl include nonsubstituted and substituted groups and an alicyclic group. Examples of a substituent group of the substituted alkyl group are halogen, nitro, cyano, hydroxyl, alkoxy, aryl, acylamino, alkoxycarbonylamino, ureido, amino, heterocycic ring, acyl, sulfamoyl, sulfonamido, thioureido, carbamoyl, alkylthio, arylthio, heterocyclic thio, a carbonic acid group, a sulfonic acid group, and their salts.

Ureido, thioureido, sulfamoyl, carbamoyl, and amino include a nonsubstituted group, an N-alkyl substituted group, and an N-aryl substituted group. Examples of aryl are phenyl or substituted phenyl, and examples of its substituent group are alkyl and the above-mentioned substituent groups on alkyl.

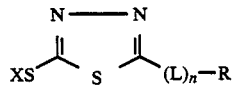

Formula [XXII]

wherein L represents a divalent bond group, R represents hydrogen, alkyl, alkenyl, or aryl. Alkyl and alkenyl of R and X have the same meanings as those of formula [XXI].

Examples of the divalent bond group represented by L are

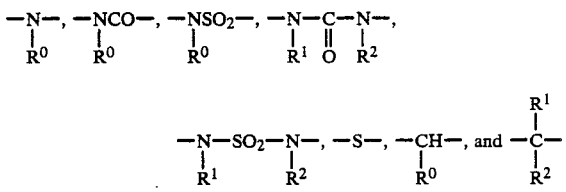

and their combinations.

n represents 0 or 1, and $R^O$, $R^1$, and $R^2$ each represent hydrogen, alkyl, or aralkyl.

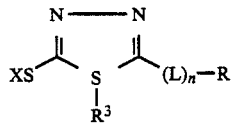

Formula [XXIII]

wherein R and X have the same meanings as those of formula [XXI], and L and n has the same meaning as those of formula [XXII]. $R^3$ has the same meaning as that of R, and they may have the same or different meanings.

The compound represented by formula [XXI], [XXII], or [XXIII] used in the present invention may be contained in either layer of the silver halide color photographic light-sensitive material and/or a color developer. The either layer of the silver halide color photographic light-sensitive material means a light-sensitive or non-light-sensitive hydrophilic colloid layer.

The content of the compound represented by formula [XXI], [XXII], or [XXIII] is preferably $1\times10^{-5}$ to $5\times10^{-2}$ mol, and more preferably, $1\times10^{-4}$ to $1\times10^{-2}$ per mol of a silver halide when it is contained in the silver halide color photographic material. When the compound is contained in the color developer, the content is preferably $1\times10^{-6}$ to 1 $10^{-3}$ mol/l, and more preferably, $5\times10^{-6}$ to $5\times10^{-4}$ mol/l.

Examples of the compounds represented by formulas [XXI], [XXII], and [XXIII] are listed in Table 14. However, the compounds are not limited to the following examples. For example, compounds described in JP-A-62-269957 page 820, upper-left column to page 824, lower-right column, may be used.

(2) Light-Sensitive Material 2-1. Color Coupler

In color development of the present invention, a color coupler may be contained in the light-sensitive material or dissolved in a developer. Preferably, the photographic material of the present invention contains at least one yellow coupler, at least one mazenta coupler, and at least one cyan coupler. It is preferable to use a nondiffusible color coupler so that the contained coupler is not diffused in a binder even under alkaline conditions. A method of dissolving and dispersing such a color coupler in a small droplet of a lipophilic oil is known to those skilled in the art.

A color coupler used in the present invention will be described below. A color coupler must satisfy general requirements such as a desired hue and a high absorptivity coefficient and must be highly active so that a coupling color forming reaction with the oxidation product of a color developing agent such as a paraphenylenediamine derivative does not become a rate-determining factor, because development of the emulsion used in the present invention progresses fast. In this respect, a coupler represented by formula [IV], [V], [VI], [VII] or [VIII] listed in Table 2 below is preferably used.

TABLE 2

| | |
|---|---|
| Formula [IV] | 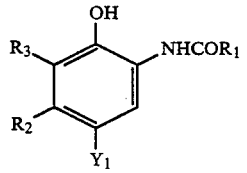 |
| Formula [V] | 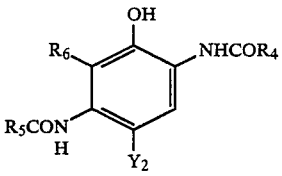 |
| Formula [VI] | 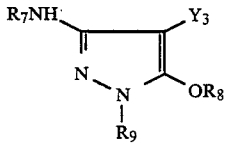 |
| Formula [VII] | 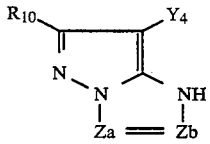 |
| Formula [VIII] | 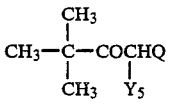 |

Wherein $R_1$, $R_4$, and $R_5$ each represent aliphatic, aromatic, heterocyclic, aromatic amino, or heterocyclic amino, $R_2$ represents aliphatic, $R_3$ and $R_6$ each represent hydrogen, halogen, aliphatic, aliphatic oxy, or acylamino, $R_7$ and $R_9$ each represent substituted or nonsubstituted phenyl, $R_8$ represents hydrogen, aliphatic or aromatic acyl, or aliphatic or aromatic sulfonyl, $R_{10}$ represents hydrogen or substituent group, Q represents substituted or nonsubstituted N-phenylcarbamoyl, Za and Zb each represent methine, substituted methine, or =N—, $Y_1$, $Y_2$, and $Y_4$ each represent halogen or a group which can be released during the coupling reaction with the oxidation product of developing agent, the group being referred to as a "releasable group" hereinafter.

$Y_3$ represents hydrogen or releasable group, $Y_5$ represents releasable group, and $R_2$ and $R_3$ or $R_5$ and $R_6$ in formulas [IV] and [V] may form a 5-, 6-, and 7-membered ring, respectively.

$R_1$, $R_2$, $R_3$ or $Y_1$; $R_4$, $R_5$, $R_6$,or $Y_2$; $R_7$, $R_8$, $R_9$ or $Y_3$; $R_{10}$, Za, Zb or $Y_4$; or Q or $Y_5$ may form a dimer or higher polymers It is preferred that $R_5$ and $R_6$ are bonded to form a 5-membered ring, thereby forming a cyan coupler of an oxyindole type or an indazoline-2-on type (U.S. Ser. No. 6,511 filed on Jan. 23, 1987).

More specifically, $R_1$, $R_2$, $R_3$, $R_4$, $R_5$, $R_6$, $R_7$, $R_8$, $R_9$, $R_{10}$, Za, Zb, $Q_1$, $Y_1$, $Y_2$, $Y_3$, and $Y_4$ in formulas [IV], [V], [VI], [VII], and [VIII] are the same as those in formulas (I), (II), (III), (IV), and (V) described in JP-A-63-11939, page 446, lower-left column to page 451, upper-left column.

Examples of these color couplers are (C-1) to (C-40), (M-1) to (M-42), and (Y-1) to (Y-46) described in JP-A-63-11939, page 451, lower-left column to page 464, lower-right column. More preferably, compounds listed in Table 15 to be presented later can be used.

A standard content of the color coupler falls within the range of 0.001 to 1 mol per mol of a light-sensitive silver halide. More specifically, contents of yellow, magenta, and cyan couplers are preferably 0.01 to 0.5 mol. 0.003 to 0.3 mol, and 0.002 to 0.3 mol, respectively.

A coating amount of silver halide in a light-sensitive material in which the color coupler represented by formula [IV], [V], [VI], [VII], or [VIII] is used is preferably 1.5 g/m$^2$ to 0.1 g/m$^2$ when a reflective support is used, and is preferably 7 g/m$^2$ to 0.2 g/m$^2$ when a transparent support is used.

These couplers can be dispersed and contained in an emulsion layer together with at least one of high boiling point organic solvents. High boiling point organic solvents represented by formulas (A) to (E) are preferably used:

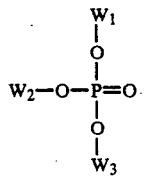

Formula (A)

$W_1-COO-W_2$ Formula (B)

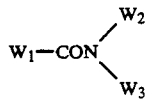

Formula (C)

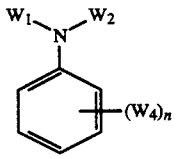

Formula (D)

$W_1-O-W_2$ Formula (E)

wherein $W_1$, $W_2$, and $W_3$ each represent substituted or nonsubstituted alkyl, cycloalkyl, alkenyl, aryl, or heterocyclic ring, $W_4$ represents $W_1$, $OW_1$, or $S-W_1$, and n represents an integer from 1 to 5. When n is 2 or more, $W_4$ may be the same or different. In formula (E), $W_1$ and $W_2$ may form a condensed ring.

2-2. Additives

The light-sensitive material according to the present invention may contain, as an antifoggant or a color mixing inhibitor, hydroquinone derivatives, aminophenol derivatives, amines, gallate derivatives, catechol derivatives, ascorbic derivatives, colorless compound forming couplers, or sulfonamidophenol derivatives.

A conventional decoloration inhibitor can be used in the light-sensitive material of the present invention. Examples of an organic decoloration inhibitor are hydroquinones, 6-hydroxychromans, 5-hydroxycoumarans, spirochromans, p-alkoxyphenols, hindered phenols mainly including bisphenols, gallate derivatives, methylenedioxybenzenes, amonophenols, hinderd amines, and an ether or ester derivative obtained by silylating or alkylating the phenolic hyroxyl group of the above compounds. A metal complex such as (bis-salicylaldoximato) nickel complex or (bis-N,N-dialkyldithiocarbamato) nickel complex can be used.

In order to prevent degradation in a yellow dye image caused by heat, moisture, and light, a compound having partial structures of hindered amine and hindered phenol in a single molecule as described in U.S. Pat. No. 4,268,593 can be effectively used. In order to prevent degradation in a magenta dye image, especially degradation caused by light, spiroindanes described in JP-A-56-159644 and a substituted chromans substituted by hydroquinonediether or monoether described in JP-A-55-89835 can be effectively used.

An image stabilizer described in JP A-59-125732 can be effectively used especially to stabilize a magenta image formed using a pyrazolotriazole magenta coupler.

In order to improve storage stability, especially lightfastness of a cyan image, it is preferable to use a benzotriazolic ultraviolet absorbent. The ultraviolet absorbent may be emulsified together with a cyan coupler.

The ultraviolet absorbent may be applied in an amount sufficient to give light stability to the cyan dye image. If the absorbent is applied too much, a nonexposed portion (white portion of the color photographic light-sensitive material may turn yellow. Therefore, the content of the ultraviolet absorbent preferably falls within the range of $1\times10^{-4}$ mol/m$^2$ to $2\times10^{-3}$ mol/m$^2$, and more preferably, $5\times10-4$ mol/m$^2$ to $1.5\times10^{-3}$ mol/m$^2$.

In a light-sensitive material layer structure of normal color paper, the ultraviolet absorbent is contained in either of, preferably, two layers adjacent to a cyan coupler-containing red-sensitive emulsion layer. When the ultraviolet absorbent is added in an interlayer between a green-sensitive layer and a red-sensitive layer, it may be emulsified together with a color mixing inhibitor. When the ultraviolet absorbent is added in a protective layer, another protective layer may be formed as an outermost layer. A mixture of a matting agent having any grain size and latex having different grain sizes may be contained in this protective layer.

In the light-sensitive material according to the present invention, the ultraviolet absorbent can be added in a hydrophilic colloid layer.

In the light-sensitive material of the present invention, in addition to the above additives, various stabilizers, pollution inhibitors, developing chemicals or their precursors, development accelerators or their precursors, lubricants, mordants, matting agents, antistatic agents, plasticizers, or other effective additives for the photographic light-sensitive material may be used. Typical examples of the above additives are described in Research Disclosure, No. 17643 (December, 1978) and No. 18716 (November, 1979).

In the light-sensitive material of the present invention, a water-soluble dye may be contained in the hydrophilic colloid layer as a filter dye or in order to prevent irradiation or halation.

The photographic emulsion layer or other hydrophilic colloid layers of the light sensitive material of the present invention may contain a stilbene type, triazine type, oxazole type, or coumarin type whitener. In this case, the whitener may be water-soluble, or a water-insoluble whitener may be used in the form of a dispersion.

2-3. Support

A reflective support which can be used in the present invention preferably increases reflectivity to obtain a clear dye image in the silver halide emulsion layer. Examples of such a reflective support are a support coated with a hydrophobic resin containing a dispersed light reflective material such as titanium oxide, zinc oxide, calcium carbonate, or calcium sulfate and a support of polyvinyl chloride containing a dispersed light reflective material. Examples are baryta paper, polyethylene coated paper, polypropylene synthetic paper, a transparent support having a reflective layer or comprising a reflective material, e.g., a glass plate, a polyester film such as a polyethyleneterephthalate, cellulose triacetate, or cellulose nitrate film, a polyamide film, a polycarbonate film, or a polystyrene film. These supports can be arbitrarily selected in accordance with a purpose. Supports having a mirror reflective surface or a surface having secondary reflectivity as described in JP-A-60-210346, Japanese Patent Application No.

61-168800 and JP-A-63-24247 may be used. A transparent support is also used in the present invention.

2-4. Layer Structure

As described above, the present invention can be applied to a multilayer multicolor photographic material having two different spectral sensitivities. A multilayer natural color photographic material normally has at least one of each of red-sensitive, green-sensitive, and blue-sensitive layers on a support. The photo graphic material of the present invention preferably comprises at least one blue-sensitive silver halide emulsion layer containing an yellow coupler, at least one green-sensitive silver halide emulsion layer containing a magenta coupler, and at least one red-sensitive silver halide emulsion layer containing a cyan coupler. An order of these layers can be arbitrarily selected. Each of the above emulsion layers may consist of two or more emulsion layers having different sensitivities, and a non-light-sensitive layer may be interposed between two or more emulsion layers having the same spectral sensitivity.

In the color light-sensitive material according to the present invention, an auxiliary layer such as a protective layer, an interlayer, a filter layer, an antihalation layer, or a backing layer is preferably formed in addition to the silver halide emulsion layer on the support.

Gelatin can be advantageously used as a binding agent or a protective colloid which can be used as an emulsion layer or an interlayer of the light-sensitive material of the present invention. However, other hydrophilic colloids can be used.

Examples are a protein such as gelatin derivative, graftpolymer of gelatin and another polymer, albumin, and casein; a cellulose derivative such as hydroxyethylcellulose, carboxymethylcellulose, and a cellulose sulfate ester, a suger derivative such as soda alginate, and a starch derivative; and a homopolymer or copolymer such as polyvinyl alcohol, polyvinyl alcohol partial acetal, poly-N-vinylpyrrolidone, polyacrylic acid, polymethacrylic acid, polyacrylamide, polyvinylimidazole, and polyvinylpyrazole. That is, various synthetic hydrophilic polymer materials can be used.

Examples of gelatin are lime-processed gelatin, acid-processed gelatin, and oxygen-processed gelatin as described in Bull. Soc. Sci. Phot. Japan. No. 16, page 30 (1966). In addition, a hydrolyzed product or oxygen-decomposed product of gelatin can be used.

2-5. Coating Silver Amount

Another characteristic of the present invention lies in that color development can be rapidly and stably performed. That is, color development can be performed within 3 minutes and 40 seconds, and preferably, within a time shorter than 3 minutes or 2 minutes and 30 seconds. In the present invention, the content of the silver halide is about 1.5 g/m$^2$ or less, and preferably, 1.2 g/m$^2$ or less when a reflective support is used, and is 7 g/m$^2$ or less, and preferably, 5 g/m$^2$ or less when a transparent support is used. When the content of the silver halide is small, not only color development but also desilverizing can be advantageously, rapidly performed.

(3) Developing Method 3-1. Color Developing Agent

An aromatic primary amino type color developing agent used in a color developer of the present invention includes developing agents known to those skilled in the art and widely used in various color photographic processes. These developing agents include aminophenol type and p-phenylenediamine type derivatives. The p-phenylenediamine type derivative is preferred and its typical examples will be listed below. However, the derivative is not limited to the following examples.

D-1: N,N-diethyl-p-phenylendiamine
D-2: 2-amino-5-diethylaminotoluene
D-3: 2-amino-5-(N-ethyl-N-laurylamino)toluene
D-4: 4-[N-ethyl-N-(β-hydroxyethyl)amino]aniline
D-5: 2-methyl-4-[N-ethyl-N-(β-hydroxyethyl-)amino]aniline
D-6: N-ethyl-N-(β-methanesulfonamidoethyl)-3-methyl-4-aminoaniline
D-7: N-(2-amino-5-diethylaminophenylethyl)methanesulfonamide
D-8: N,N-dimethyl-p-phenylenediamine
D-9: 4-amino-3-methyl-N-ethyl-N-methoxyethylaniine
D-10: 4-amino-3-methyl-N-ethyl-N-β-ethoxyethylaniline
D-11: 4-amino-3-methyl-N-ethyl-N-β-butoxyethylaniline The above p-phenylenediamine derivatives may be in the form of salts such as sulfate, hydrochloride, sulfite, and p-toluenesulfonate. The above compounds are described in U.S. Pat. Nos. 2,193,015, 2,552,241, 2,566,271, 2,592,364, 3,656,950, and 3,698,525. The content of the aromatic primary amine developing agent is about 0.1 g to about 20 g, and more preferably, about 0.5 g to about 10 g per liter of the developer.

3-2. Color Developer

The color developer used in the present invention can contain hydroxylamines.

Although the hydroxylamines can be used in the form of a free amine in a color developer, it is more general to use the hydroxylamines in the form of a water-soluble acid salt. Examples of such a salt are sulfate, oxalate, hydrocloride, phosphate, carbonate, acetate, and the like. The hydroxylamines may be substituted or nonsubstituted, and nitrogen atom of the hydroxylamines may have substituent of alkyl.

The content of hydroxylamine is preferably 0 g to 10 g, and more preferably, 0 g to 5 g per liter of the color developer. A smaller content is preferred as long as stability of the color developer is maintained.

A sulfite such as sodium sulfite, potassium sulfite, sodium bisulfite, potassium bisulfite, sodium metasulfite or potassium metasulfite, or a carbonyl sulfite adduct is preferably contained as a preservative. The content of the above compounds is preferably 0 g to 20 g/l, and more preferably, 0 g to 5 g/l. A smaller content is preferred as long as stability of the color developer is maintained.

Examples of the preservative are aromatic polyhydroxy compounds described in JP-A-52-49828, JP-A-56-47038, JP-A-56-32140, 59-160142, and U.S. Pat. No. 3,746,544; hydroxyacetones described in U.S. Pat. No. 3,615,503 and British Patent No. 1,306,176; α-aminocarbonyl compounds described in JP-A-52-143020 and JP-A-53-89425 various metals described in JP-A-57-44148 and JP-A-57-53749; various sugars described in JP-A- 52-102727; an α-α'-dicarbonyl compound described in JP-A-59-160141; salicylic acids described in JP-A-59-180588; alkanolamines described in JP-A-54-3532; poly(alkyleneimine)s described in JP-A-56-94349; and a gluconic acid derivative described in JP-A-56-75647. These preservatives may be used singly or in a combination of two or more types. Especially, 4,5-dihydroxy-m-benzenedisulfonic acid, poly(ethyleneimine), and triethanolamine are preferred.

The pH of the color developer used in the present invention falls within the range of, preferably 9 to 12, and more preferably, 9 to 11.0. The color developer may contain a compound of known developer components.

In order to maintain the above pH, it is preferable to use various buffering agents. Examples of the buffering agent are carbonate, phosphate, borate, tetraborate, hydroxybenzoate, glycine salt, N,N-dimethylglycine salt, leucine salt, norleucine salt, guanine salt, 3,4-dihydroxyphenylalanine salt, alanine salt, aminobutyrate, 2-amino-2-methyl-1,3-propanediol salt, valine salt, proline salt, trishydroxylaminomethane salt, and lysine salt. Especially, carbonate, phosphate, tetraborate, and hydroxybenzoate have good solubility and a good buffering property in a high pH region of pH 9.0 or more, do not adversely affect a photographic property (e.g., fogging) when they are added to the color developer, and are inexpensive. Therefore, it is most preferable to use these buffering agents.

Examples of such the buffering agent are sodium carbonate, potassium carbonate, sodium bicarbonate, potassium bicarbonate, sodium tertiary phosphate, potassium tertiary phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2 hydroxybenzoate (sodium 5-sulfosalicylate), and potassium 5-sulfo-2-hydroxybenzoate (potassium 5-sulfosalicylate). However, the present invention is not limited to these compounds.

The content of the buffering agent to the color developer is preferably 0.1 mol/l or more, and more preferably, 0.1 mol/l to 0.4 mol/l.

In the color developer, various chelating agents may be used as a precipitation inhibitor for calcium or magnesium or in order to improve stability of the color developer.

An organic acid compound is preferable as the chelating agent. Examples of the compound are aminopolycarbonic acids described in JP-A(examined)-48-030496 and JP-A(examined)-44-30232, organic phosphonic acids described in JP-A-56-97347, JP-B-56-39359, and West German Patent Application (OLS) No. 2,227,639, phosphonocarbonic acids described in JP-A-52-102726, JP-A-53-42730, JP-A-54-121127, JP-A-55-126241, and JP-A-55-65956, and compounds described in JP-A-58 195845, JP-A-58-203440 and JP-B-53-40900. Although the examples are listed below, the compounds are not limited to the following examples.

Nitrilotriacetic Acid
Diethyleneaminepentaacetic Acid
Ethylenediaminetetraacetic Acid
Triethylenetetraminehexaacetic Acid
N,N,N-trimethylenephophonic Acid
Ethylenediamine-N,N,N',N'-tetramethylenephosphonic Acid
1,3-diamino-2-propanol-tetraacetic Acid
Transcyclohexanediaminetetraacetic Acid
Nitrilotripropionic Acid
1,2-diaminopropanetetraacetic Acid
Hydroxyethyliminodiacetic Acid
Glycoletherdiaminetetraacetic Acid
Hydroxyethylenediaminetriacetic Acid
Ethylenediamineorthohydroxyphenylacetic Acid
2-phosphonobutane-1,2,4-tricarbonic Acid
1-hydroxyethane-1,1-diphosphonic Acid
N,N'-bis(2-hydroybenzyl)ethylenediamine-N,N'-diacetic Acid These chelating agents may be used singly or in a combination of two or more types. These chelating agents need only be added in an amount sufficient to hinder metal ions in the color developer. For example, the content is 0.1 g to 10 g per liter.

An arbitrary development accelerator can be added to the color developer.

Examples of the development accelerator are thioether type compounds described in JP-A(examined)-37-16088, JP-A(examined)-37-5987, JP-A(examined)-38-7826, JP-A(examined)-44-12380, JP-A(examined)-45-9019, and U.S. Pat. No. 3,813,247; p-phenylenediamine type compounds described in JP-A-52-49829 and JP-A-50-15554, and quaternary ammonium salts described in JP-A-50-137726, JP-A(examined)-44-30074, JP-A-56-156826 and JP-A-52-43429; p-aminophenols described in U.S. Pat. Nos. 2,610,122 and 4,119,462; amino type compounds described in U.S. Pat. Nos. 2,494,903, 3,128,182, 4,230,796, and 3,253,919, JP-A(examined)-41-11431, and U.S. Pat. Nos. 2,482,546, 2,596,926, and 3,582,346; and polyalkyleneoxides described in JP-A(examined)-37-16088, JP-A(examined)-42-25201, U.S. Pat. No. 3,128,183, JP-A(examined)-41-11431, JP-A(examined)-42-23883, and U.S. Pat. No. 3,532,501. In addition, 1-phenyl-3-pyrazolidones, hydrozines, a methoion type compound, a thion type compound, imidazoles, and the like can be added as needed. Especially, the thioether type compound or 1-phenyl-3-pyrazolidones are preferable.

An arbitrary antifoggant can be added to the color developer of the present invention as needed. Examples of the antifoggant are an alkali metal halide such as potassium bromide, sodium chloride, or potassium iodide combined with the compound represented by formula [XXI], [XXII], or [XXIII], and other organic antifoggants. Examples of the organic antifoggant are a nitrogen-containing heterocyclic compound such as benzotriazole, 6-nitrobenzimidazole, 5-nitroisoindazole, 5-methylbenzotriazole, 5-nitrobenzotriazole, 5-chlorobenzotriazole, 2-thiazolyl-benzimidazole, 2-thiazolylmethyl-benzimidazole, and hydroxyazaindolizine, a mercapto-substituted heterocyclic compound, represented by a formula other than formula [XXI], [XXII], or [XXIII], such as 2-mercaptobenzimidazole and 2-mercaptobenzothiazole, and a mercapto substituted aromatic compound such as adenine and thiosalicylic acid. These antifoggants may be eluted from the color light-sensitive material during the process and stored in the color developer. In this case, in order to reduce a discharge amount, a smaller storage amount is preferred.

The color developer of the present invention preferably contains a fluorescent whitening agent. A 4,4-diamino-2,2'-disulfostilbene type compound is preferable as the fluorescent whitening agent. The content of the compound is 0 to 5 g/l, and preferably, 0.1 g to 2 g/l.

Various surface-active agents such as alkylphosphonic acid, arylphosphonic acid, aliphatic carbonic acid, and aromatic carbonic acid can be added as needed.

A process temperature of the color developer in the present invention is preferably 30° C. to 50° C., and more preferably, 33° C. to 42° C. A replenishment amount is 2,000 ml or less, and preferably, 1,500 ml or less per $m^2$ of light-sensitive material In order to reduce a waste liquor amount, a smaller replenishment amount is preferred.

In the color developer of the present invention, in order to achieve rapid development by a color developer substantially not containing benzyl alcohol which is disadvantageous in terms of environmental pollution, storage stability of a color image, or generation of a stain, a color developing system may be constituted such that both of a restoring agent for the oxidation product of a color developing agent described in Japanese Patent Application No. 61-259799 and a trapping agent for the oxidation product of the restoring agent are used.

In the present invention, it is preferred that the color developer substantially does not contain iodide ions. In this case, "substantially does not contain iodide ions" means that the color developer contains not more than 1 mg/l of iodide ions. In addition, in the present invention, it it preferred that the color developer substantially does not contain sulfite ions. In this case, "substantially does not contain sulfite ions" means that the color developer contains not more than 0.02 mol/l of sulfite ions.

3-3. Desilverizing

The color photographic light-sensitive material of the present invention is desilverized after color development. In this case, a desilverizing process can include at least one of bleaching, fixing, and bleach-fixing (e.g., bleach-fixing; bleaching and fixing; bleaching and bleach-fixing; and fixing and bleach-fixing).

An example of a bleaching agent used in a bleaching solution or a bleach fixing solution of the present invention is a ferric iron ion complex which is a complex of ferric iron ion and a chelating agent such as aminopolycarbonic acid, aminopolyphosphonic acid, or its salt. Aminopolycarbonate or aminopolyphosphonate is a salt of aminopolycarbonic acid or aminopolyphosphonic acid and an alkali metal, ammonium, or water-soluble amine. Examples of the alkali metal are sodium, potassium, and lithium. Examples of the water-soluble amine are an alkylamine such as methylamine, diethylamine, triethylamine, and butylamine, cycloaliphatic amine such as cyclohexylamine, an arylamine such as aniline and m-toluidine, and a heterocyclic amine such as pyridine, morpholine, and piperidine.

Examples of the chelating agent such as aminopolycarbonic acid, aminopolyphosphonic acid, and their salts are as follows:

Ethylenediaminetetraacetic Acid Disodium Salt
Ethylenediaminetetraacetic Acid Diammonium Salt
Ehtylenediaminetetraacetic Acid
Tetra(trimethylammonium) Salt
Ethylenediaminetetraacetic Acid Tetrapotassium Salt
Ethylenediaminetetraacetic Acid Tetrasodium Salt
Ethylenediaminetetraacetic Acid Trisodium Salt
Diethylenetriaminepentaacetic Acid
Diethylenetriaminepentaacetic Acid Pentasodium Salt
Ethylendiamine-N-(β-oxyethyl)-N,N',N'-triacetic Acid
Ethylenediamine-N-(β-oxyethyl)-N,N',N'-triacetic Acid Trisodium Salt
Ethylenediamine-N-(β-oxyethyl)-N,N',N'-triacetic Acid Triammonium Salt
Propylenediaminetetraacetic Acid
Propylenediaminetetraacetic Acid Disodium Salt
Nitrilotriacetic Acid
Nitrilotriacetic Acid Trisodium Salt
Cyclohexanediaminetetraacetic Acid
Cyclohexanediaminetetraacetic Acid Disodium Salt
Iminodiacetic Acid
Dihydroxyethylglycine
Etyletherdiaminetetraacetic Acid
Glycoletherdiaminetetraacetic Acid
Ethylenediaminetetrapropionic Acid
Phenylenediaminetetraacetic Acid
1,3-diaminopropanol-N,N,N',N'-tetramethylenephosphonic Acid
Ethylenediamine-N,N,N',N'-tetramethylenephosphonic Acid
1,3-propylenediamine-N,N,N',N'-tetramethylenephosphonic Acid It is a matter of course that the compound is no limited to the above examples.

A ferric iron ion complex salt may be used in the form of a complex salt or formed in a solution using a ferric iron salt such as ferric iron sulfate, ferric iron chloride, ferric iron nitrate, ferric iron ammonium sulfate, and ferric iron phosphate and a chelating agent such as aminopolycarbonic acid, aminopolyphosphonic acid, and phosphonocarbonic acid. When a ferric iron ion complex salt is used in the form of a complex salt, one or more types of complex salt may be used. When a complex salt is formed in a solution using a ferric iron salt and a chelating agent, one or more types of ferric iron salt may be used. In this case, one or more types of chelating agent may be used. In either case, the chelating agent may be used in an amount larger than that required to form the ferric iron ion complex salt. An aminopolycarbonic acid iron complex is preferred as the iron complex, and its content is 0.01 to 1.0 mol/l, and more preferably, 0.05 to 0.50 mol/l.

An accelerator for bleaching can be used, if necessary, in the bleaching or bleach-fixing solution. Specific examples of the useful accelerator for bleaching are: compounds having a mercapto group or a disulfide group described in U.S. Pat. No. 3,893,858, West German Patent Application (OLS) Nos. 1,290,812 and 2,059,988, JP-A-53-32736, JP-A-53-57831, JP-A-53-37418, JP-A-53-65732, JP A-53 72623, JP-A-53-95630, JP-A-53-95631, JP A-53-104232, JP-A-53-124424, JP-A-53-141623, JP-A-53-28426, and Research Disclosure No. 17129 (July, 1978); thiazolidine derivatives described in JP-A-50-140129; thiourea derivatives described in JP-A(examined)-45-8506, JP-A-52-20832, JP-A-53-32735, and U.S. Pat. No. 3,706,561; iodides described in West German Patent Application (OLS) No. 1,127,715 and JP-A-58-16235; polyethylene oxides described in West German Patent Application (OLS) Nos. 966,410 and 2,748,430; a polyamine compound described in JP-A(examined)-45-8836; compounds described in JP-A-49-42434, JP-A-49-59644, JP-A-53-94927, JP-A-54-35727, JP-A-55-26506, and JP-A-58-163940; and iodide and bromide ions. The compounds having a mercapto group or a disulfide group are preferable due to an excellent acceleration effect. More specifically, the compounds described in U.S. Pat. No. 3,893,858, West German Patent Application (OLS) No. 1,290,812, and JP-A-53-95630 are preferable.

The bleaching solution or the bleach-fixing solution of the present invention may contain rehalogenation agents such as a bromide (e.g., potassium bromide, sodium bromide, and ammonium bromide), a chloride (e.g., potassium chloride, sodium chloride, and ammonium chloride), or an iodide (e.g., ammonium iodide). Further, the bleaching solution or the bleach-fixing solution contain, if necessary, one or more of inorganic and organic acids, their alkali metals, or their ammonium salts and, having a pH buffering function, such as boric acid, borax, sodium methaborate, acetic acid, sodium acetate, sodium carbonate, potassium carbonate, phosphorous acid, phosphoric acid, sodium phosphate, citric acid, sodium citrate, and tartaric acid, or a corrosion inhibitor such as ammonium nitrate or guanidine.

A fixing agent used in the bleach-fixing or the fixing solution of the present invention is a known fixing agent. Examples of the known fixing agent are water-soluble silver halide solvents such as: a thiosulfate, e.g., sodium thiosulfate and ammonium thiosulfate; a thiocyanate, e.g., sodium thiocyanate and ammonium thiocyanate; a thioether compound, e.g., ethylenebisthioglycolic acid and 3,6-dithia-1,8-octanediol; and thioureas. These compounds may be used singly or in a combination of two or more types. A special bleach-fixing solution consisting of a fixing agent and a large amount of a halide such as iodide, described in JP-A-55-155354 can be used. In the present invention, a thiosulfate, especially, ammonium thiosulfate is preferred.

The content of the fixing agent per liter is preferably 0.3 to 2 mol, and more preferably, 0.5 to 1.0 mol.

In the present invention, the pH of the bleach-fixing or fixing solution preferably falls within the range of 3 to 10, and more preferably, 4 to 9. If the pH of the solution is lower than the minimum value of the range, the desilverizing effect can be improved, but the solution is degraded and the cyan dye is converted into a leuco form. However, if the pH of the solution is higher than the maximum value of the range, desilverizing is delayed and stain tends to occur.

In order to adjust the pH of the solution, hydrochloric acid, sulfuric acid, nitric acid, acetic acid (glacial acetic acid), bicarbonate, ammonia, caustic potash, caustic soda, sodium carbonate, potassium carbonate, or the like can be added to the solution.

The bleach-fixing solution may contain various fluorescent whitening agents, an antifoamer or a surface-active agent, polyvinylpyrrolidone, and an organic solvent such as methanol.

The bleach-fixing and the fixing solutions can contain a sulfite ion releasing compound as a preservative, such as a sulfite (e.g., sodium sulfite, potassium sulfite, and ammonium sulfite), a bisulfite (e.g., ammonium bisulfite, sodium bisulfite, and potassium bisulfite), and a methabisulfite (e.g., potassium methabisulfite, sodium methabisulfite, and ammonium methabisulfite). The content of these compounds is about 0.02 to 0.50 mol/l, and more preferably, 0.04 to 0.40 mol/l as an amount of sulfite ion.

A typical preservative is a sulfite. However, ascorbic acid, a carbonyl bisulfite adduct, or a carbonyl compound may be used.

A buffering agent, a fluorescent whitening agent, a chelating agent, a mildewproofing agent, and the like may be added as needed.

As the bleaching agent of the bleach-fixing solution, it is preferred to use at least one of iron (III) complex salts of ethylenediaminetetraacetic acids, iron (III) complex salts of diethylenetriaminepentaacetic acids, and iron (III) complex salts of cyclohexanediaminetetraacetic acids.

3-4. Washing and Stabilizing

A washing step of the present invention will be described below. In the present invention, a simplified process method in which only a so-called "stabilizing process" without a washing step is performed in place of a conventional "washing process" can be used. That is, the term "washing process" of the present invention is used in a broad sense.

It is difficult to determine an amount of water used in the washing process of the present invention because it varies in accordance with the number of water tanks of multi-stage counter-current washing or an amount of preceding tank components in the light-sensitive material. However, in the present invention, a bleach-fixing solution component in the last washing water tank need be $1\times10^{-4}$ mol/l or less. For example, in 3-tank counter-current washing, water is used in an amount of preferably about 1,000 ml or more, and more preferably, 5,000 ml or more per $m^2$ of the light-sensitive material. In a water-saving process, water may be used in an amount of preferably 100 to 1,000 ml per $m^2$ of the light-sensitive material.

A washing temperature is 15° C. to 45° C., more preferably, 20° C. to 35° C.

In the washing process, various known compounds may be added in order to prevent precipitation or to stabilize washing water. For example, a chelating agent such as inorganic phosphoric acid, aminopolycarbonic acid, and organic phosphonic acid, a germicide or an antifungal agent for preventing generation of various bacteria, algae, and fungi (e.g., a compound described in "J. Antibact. Antifung. Agents", Vol. 11, No. 5, PP. 207 to 223 (1983) and a compound described in "Chemistry of Antibacterial and Antifungal Agents" by Hiroshi Horiguchi), a metal salt such as magnesium salt and aluminum salt, an alkali metal salt and an ammonium salt, or a surface-active agent for preventing a dry load or uneveness may be added as needed. A compound described in "Photo. Sci. Eng.", Vol. 6, PP. 344 to 359 (1965) may be added.

The present invention is effective especially when a chelating agent, a germicide, or an antifungal agent is added to washing water and an amount of washing water is largely reduced by multi-stage counter-current washing of two or more water tanks. The present invention is also effective when a multi-stage counter-current stabilizing process step (so-called stabilizing process) as described in JP-A-57-8543 is performed in place of a normal washing step. In these cases, a bleach-fixing solution component in the last water tank need be $5\times10^{-2}$ or less, and preferably, $1\times10^{-2}$ or less.

Various compounds are added to the stabilizing tank of the present invention in order to stabilize an image. Examples are various buffering agents for adjusting a film pH (e.g., pH 3 to 8) (in this case, borate methaborate, borax, phosphate, carbonate, potasium hydroxide, sodium hydroxide, ammonium water, monocarbonic acid, dicarbonic acid, polycarbonic acid, and the like are used in combination), and an aldehyde such as formalin. In addition, various additives such as a chelating agent (e.g., inorganic phosphoric acid, aminopolycarbonic acid, organic phosphonic acid, aminopolyphosphonic acid, and phosphonocarbonic acid), a bactericide (e.g., thiazole type, isothiazole type, phenol halide, sulfanylamide, and benzotriazole), a surface-active agent, a fluorescent whitening agent, and a film-hardening agent may be used. In this case, two or more types of compounds having the same or different purposes may be used.

In order to improve an image storage stability, it is preferable to add various ammonium salts such as ammonium chloride, ammonium nitrate, ammonium sulfate, ammonium phosphate, ammonium sulfite, and ammonium thiosulfate as a film pH adjusting agent of a processing solution.

When washing water is largely reduced as described above part or all of overflow liquid of washing water is preferably flowed into a preceding tank i.e. a bleach-fixing water tank or a fixing water tank, in order to reduce a discharge liquid amount.

In this developing process, it is preferred to continuously perform color development using a color developer in which the content of bromide ions is preferably maintained to be $1.0\times10^{-2}$/l or less, and more preferably, $0.5\times10^{-2}$/l or less.

In this developing process, a cycle including color development, desilverizing, washing, and drying can be performed within 120 seconds.

When this processing step is continuously performed, a replenishing liquid of each processing liquid is used to prevent variations in liquid composition, thereby obtaining a constant photofinishing. A replenishment amount can be reduced to be half or less of a standard replenishment amount, whereby the cost of developing the photographic material is lowered.

In each processing tank, a heater, a temperature sensor, a liquid surface sensor, a circulation pump, a filter, various types of a floating cover, various types of squeegee, a nitrogen agitator, an air agitator, and the like may be provided.

Any processing can be applied to the light-sensitive material of the present invention as long as a color developer is used. Examples of processing are those for color paper, color reversal paper, a color positive film, a color negative film, a color reversal film, and the like.

The present invention will be described in detail below by way of its examples. However, the present invention is not limited to these examples.

EXAMPLE 1

Silver halide emulsion (1) was prepared as follows.

| | |
|---|---|
| (Solution 1) | |
| $H_2O$ | 800 ml |
| NaCl | 4.5 g |
| Gelatin | 25 g |
| (Solution 2) | |
| NaCl | 1.7 g |
| Water to make | 140 ml |
| (Solution 3) | |
| $AgNO_3$ | 5.0 g |
| Water to make | 140 ml |
| (Solution 4) | |
| NaCl | 41.3 g |
| Water to make | 320 ml |
| (Solution 5) | |
| $AgNO_3$ | 120 g |
| Water to make | 320 ml |

(Solution 1) was heated up to 55° C., and (Solution 2) and (Solution 3) were simultaneously added to (Solution 1) over 10 minutes. 10 minutes after the addition, (Solution 4) and (Solution 5) were simultaneously added to the resultant over 35 minutes. Five minutes after the addition, the temperature of the resultant was reduced, and the resultant was desalted.

Water and dispersion gelatin were added to the desalted resultant and the pH was adjusted to 6.2, thereby preparing monodispersion cubic silver chloride emulsion (1) having an average grain size of 0.70 μ and a variation coefficient of 0.13 (a value obtained by dividing the standard deviation by the average grain size). $2\times10^{-4}$ mol of sensitizing dye XX-10 (shown in Table 13) per mol of the silver halide were added to emulsion (1) at 58° C., and 1 mol % of a fine grain emulsion (grain size: 0.05 μ) per mol of the silver halide was added to the resultant emulsion. Thereafter, sodium thiosulfate, chloroauric acid, and ammonium thioyanate were added to the resultant emulsion, and chemical ripening was performed in the presence or absence of a thiosulfonate compound according to the present invention for 70 minutes as shown in Table 3, thereby preparing emulsions (101) to (108).

100 g of magenta coupler (Ex Ml) were dissolved together with 80 g of color image stabilizer (Cpd-3) and 38 g of color image stabilizer (Cpd-4) in a solution mixture of 130 ml of solvent (Solv-2) and 100 ml of ethylacetate. The resultant solution was emulsified and dispersed in 1,200 g of a 10% aqueous gelatin solution containing 4.0 g of sodium dodecylbenzenesulfonate, thereby preparing emulsified dispersion (A). Chemical structures of the used compounds are listed in Table 16.

Eight samples of sample 101 to 108 listed in Table 3 having the contents as shown in Table 4 were prepared. Polyethylene at the side on which the emulsion and protective layers were applied contained titanium dioxide and a small amount of ultramarine blue. 1-oxy-3,5-dichloro-s-triadine sodium salt was used as a film hardening agent for each layer.

The following experiment was conducted to examine photographic properties of these coated samples.

Sensitometric gradation exposure was performed for the coated samples through a green filter using a sensitometer FWH (available from Fuji Photo Film Co., Ltd.; color temperature of light source: 3,200° K.). In this case, exposure was performed for an exposure time of 1/10 sec or 1/100 sec, to obtain an amount of exposure of 250 CMS.

Thereafter, the following color developing process was performed.

| Process | Temperature | Time |
|---|---|---|
| Color Development | 35° C. | 45 sec. |
| Bleach-Fixing | 35° C. | 45 sec. |
| Washing | 28 to 35° C. | 90 sec. |

| Color Developer | |
|---|---|
| Triethanolamine | 8.12 g |
| N,N-diethylhydroxylamine | 4.93 g |
| Phosphor Bleach Solution (UVITEXCK, available from Ciba-Geigy Corp.) | 2.80 g |
| 4-amino-3-methyl-N-ethyl-N-[β-(methanesulfoneamido)ethyl]-p-phenylenediamine Sulfate | 4.96 g |
| Sodium Sulfite | 0.13 g |
| Potassium Carbonate | 18.40 g |
| Potassium Hydrogencarbonate | 4.85 g |
| EDTA.2Na.$2H_2O$ | 2.20 g |
| Sodium Chloride | 1.36 g |
| Water to make | 1,000 ml |
| pH | 10.05 |

The bleaching-fixing solution employed was conventional. Sensitometry of the resultant sample was carried out in a usual manner. The results are shown in Table 3.

TABLE 3

| Sample No. (Emulsion No.) | Thiosulfonate Compound: Compound* | Thiosulfonate Compound: Addition Amount (per mol of silver halide) | Photographic Properties: Sensitivity 1/100 sec. | Photographic Properties: Sensitivity 1/100 sec. | Photographic Properties: Fog | Remarks |
|---|---|---|---|---|---|---|
| 101 | — | — | 100 | 89 | 0.52 | Comparative Example |
| 102 | Compound a | 5 mg | 142 | 135 | 0.08 | Present Invention |
| 103 | Sodium Benzenesulfonate | " | 105 | 93 | 0.53 | Comparative Example |
| 104 | Sodium Benzenesulfinate | " | 52 | 33 | 0.72 | Comparative Example |
| 105 | Compound c | 10 mg | 158 | 151 | 0.07 | Present Invention |
| 106 | Compound g | " | 151 | 148 | 0.06 | Present Invention |
| 107 | Compound h | " | 166 | 162 | 0.08 | Present Invention |
| 108 | Compound i | 15 mg | 174 | 170 | 0.09 | Present Invention |

*Structures of Compounds a, c, g, h and i are shown in Table 1.

As is apparent from Table 3, the emulsions of the present invention have much higher sensitivity, less reciprocity failure, and less fog than those of the comparative examples.

TABLE 4

| | |
|---|---|
| Support | |
| Both-surface-polyethylene-laminated Paper | |
| Support | |
| Emulsion | |
| Coating Silver Amount | 400 mg/m$^2$ |
| Emulsified Dispersion:Emulsified Dispersion A | |
| Magenta Coupler | |
| Ex M1 | 350 mg/m$^2$ |
| Color Mixing Inhibitor | |
| Cpd-3 | 280 mg/m$^2$ |
| Cpd-4 | 133 mg/m$^2$ |
| Coupler Solvent | |
| solv-2 | 0.455 mg/m$^2$ |

Gelatin was added to a coating solution so that a gelatin coating amount became 1,500 mg/m$^2$.

EXAMPLE 2

Two strips were sampled from each sample. One of the strips was left at 50° C. and a relative humidity of 20% for three days. The other strip was left at −20° C. for three days. Thereafter, sensitometry exposure and color development were performed following the same procedures as in Example 1 to form a magenta image, and density measurement was performed using an optical densitometer.

The results are summarized in Table 5 below.

TABLE 5

| Sample No. (Emulsion No.) | Thiosulfonate Compound: Compound | Thiosulfonate Compound: Addition Amount (per mol of silver halide) | Photographic Properties (Fog): left in 50° C. × 10% | Photographic Properties (Fog): left in −20° C. | Remarks |
|---|---|---|---|---|---|
| 101 | — | — | 0.86 | 0.52 | Comparative Example |
| 102 | Compound a | 5 mg | 0.09 | 0.08 | Present Invention |
| 103 | Sodium Benzenesulfonate | " | 0.87 | 0.53 | Comparative Example |
| 104 | Sodium Benzenesulfinate | " | 1.00 | 0.72 | Comparative Example |
| 105 | Compound c | 10 mg | 0.08 | 0.07 | Present Invention |
| 106 | Compound g | " | 0.07 | 0.06 | Present Invention |
| 107 | Compound h | " | 0.07 | 0.08 | Present Invention |
| 108 | Compound i | 15 mg | 0.09 | 0.09 | Present Invention |

As is apparent from Table 5, according to the samples of the present invention, an increase in fog was significantly small when they were preserved even at high and low temperatures, and therefore the advantages of the present invention were attained.

EXAMPLE 3

Multilayered color print paper having the following layers was prepared on a paper support on two surfaces of which polyethylene films were laminated.

A coating liquid was prepared by mixing and dissolving emulsions, various chemicals, and emulsified dispersions of couplers. Methods of preparing the coating solution will be described below.

Preparation of Coupler Emulsified Dispersions 19.1 g of a yellow coupler Ex Y and 4.4 g of a color image stabilizer Cpd 1 were added to and dissolved in 27.2 cc of ethyl acetate and 7.7 cc of solvent Solv,-1. The resultant solution was emulsified and dispersed in 185 cc of a 10% gelatin aqueous solution containing 8 cc of 10% sodium dodecylbenzenesulfonate.

Emulsified dispersions for magenta coupler containing layer, cyan coupler containing layer, and interlayer were prepared following the same procedures as described above.

The compounds used in the respective emulsions are listed in Table 17 to be presented later.

$2.5\times10^{-4}$ mol of a stabilizer (XXI-7 shown in Table 14) per unit mol of the silver halide were added to a blue-sensitive emulsion layer.

$10^{-4}$ mol/molAg of compound Ex-3d listed in Table 17 was added as a stabilizer to each of the above emulsions.

The resultant emulsions were coated in combinations as listed in Table 7 below, thereby preparing samples 301 to 309.

All couplers are used in an equimolar amount.

TABLE 7

| | Layer 1 | | Layer 3 | | Layer 5 | | |
|---|---|---|---|---|---|---|---|
| Sample No. | Emulsion | Coupler | Emulsion | Coupler | Emulsion | Coupler | Remarks |
| 301 | (301) | Ex Y | (303) | Ex M1 | (305) | Mixture of ExC1 and ExC2 at weight Ratio of 1:1 | Comparative Example |
| 302 | (302) | Ex Y | (304) | Ex M1 | (306) | Mixture of ExC1 and ExC2 at weight Ratio of 1:1 | Present Invention |
| 303 | (302) | Ex Y | (304) | Ex M1 | (306) | Mixture of ExC1 and ExC2 at weight Ratio of 1:1 | Present Invention |
| 304 | (302) | Ex Y | (304) | Ex M2 | (306) | Ex C4 | Present Invention |
| 305 | (302) | Ex Y | (304) | Ex M3 | (306) | Ex C4 | Present Invention |
| 306 | (302) | Ex Y | (304) | Ex M4 | (306) | Ex C4 | Present Invention |
| 307 | (302) | Ex Y | (304) | Ex M3 | (306) | Ex C3 | Present Invention |
| 308 | (302) | Ex Y | (304) | Ex M3 | (306) | Ex C5 | Present Invention |
| 309 | (302) | Ex Y | (304) | Ex M3 | (306) | Ex C1 | Present Invention |

1-oxy-3,5-dichloro-s-triadine sodium salt was used as a gelatin hardener for each layer.

In order to prevent irradiation, dyes Ex-3a and Ex-3b in Table 17 were added to the emulsion layer.

$2.6\ 10^{-3}$ mol of compound Ex-3c listed in Table 17 per unit mol of the silver halide were added to a red-sensitive emulsion layer.

A method of preparing emulsions employed in this example will be described below.

Emulsions 301 to 306 were prepared under the same condition as emulsion (1), except for the grain formation temperature as is shown in Table 6, and were then optimally, chemically sensitized.

TABLE 6

| Emulsion No. | Grain Formation Temperature | Thiosulfonate Compound | Sensitizing Dye | Grain Size (μ) | Variation Coefficient (%) |
|---|---|---|---|---|---|
| (301) | 65° C. | — | Ex Dye B $2.3\times10^{-4}$ mol/mol of Ag | 0.7 | 13 |
| (302) | 65° C. | Compound a (5 mg/mol of Ag) | Ex Dye B $2.3\times10^{-4}$ mol/mol of Ag | 0.7 | 13 |
| (303) | 42° C. | — | Ex Dye G $4\times10^{-4}$ mol/mol of Ag | 0.4 | 12 |
| (304) | 42° C. | Compound a (5 mg/mol of Ag) | Ex Dye G $4\times10^{-4}$ mol/mol of Ag | 0.4 | 12 |
| (305) | 42° C. | — | Dx Dye R $1.5\times10^{-4}$ mol/mol of Ag | 0.4 | 12 |
| (306) | 42° C. | Compound a (5 mg/mol of Ag) | Dx Dye R $1.5\times10^{-4}$ mol/mol of Ag | 0.4 | 12 |

Structures of Compound a is shown in Table 1.

(Layer Structure)

Compositions of layers in sample 301 will be described below. Numerals indicate coating amounts ($g/m^2$). As to silver halide emulsion, numerals indicate silver amount.

| | |
|---|---|
| Support | |
| Polyethylene Laminate Paper [Polyethylene on layer 1 side contains white pigment ($TiO_2$) and bluish dye (navy blue)] | |
| Layer 1 (Blue-Sensitive Layer) | |
| Silver Halide Emulsion | 0.30 |

-continued

| | |
|---|---|
| Gelatin | 1.86 |
| Yellow Coupler Ex Y | 0.82 |
| Color Image Stabilizer Cpd-1 | 0.19 |
| Solvent Solv-1 | 0.35 |
| Layer 2 (Color Mixing Inhibitor Layer) | |
| Gelatin | 0.99 |
| Color Mixing Inhibitor Cpd-2 | 0.08 |
| Layer 3 (Green-Sensitive Layer) | |
| Silver Halide Emulsion | 0.36 |
| Gelatin | 1.24 |
| Magenta Coupler Ex M1 | 0.31 |
| Color Image Stabilizer Cpd-3 | 0.25 |
| Color Image Stabilizer Cpd-4 | 0.12 |
| Solvent Solv-2 | 0.42 |
| Layer 4 (Ultraviolet Absorption Layer) | |
| Gelatin | 1.58 |
| Ultraviolet Absorbent UV-1 | 0.62 |
| Color Mixing Inhibitor Cpd-5 | 0.05 |
| Solvent Solv-3 | 0.24 |
| Layer 5 (Red-Sensitive Layer) | |
| Silver Halide Emulsion | 0.23 |
| Gelatin | 1.34 |
| Cyan Coupler (1:1 mixture of Ex C1 & Ex C2) | 0.34 |
| Color Image Stabilizer Cpd-6 | 0.17 |
| Polymer Cpd-7 | 0.40 |
| Solvent Solv-4 | 0.23 |
| Layer 6 (Ultraviolet Absorption Layer) | |
| Gelatin | 0.53 |
| Ultraviolet Absorbent UV-1 | 0.21 |
| Solvent Solv-3 | 0.08 |
| Layer 7 (Protective Layer) | |
| Gelatin | 1.33 |
| Acrylic Denaturated Copolymer of Polyvinyl Alcohol (Degree of denaturation: 17%) | 0.17 |
| Liquid Paraffin | 0.03 |

Coated samples 301 to 309 were subjected to color development in accordance with the processing solutions and processing steps described in Example 1, thereby comparing sensitivities and fog of the blue-, green-, and red-sensitive layers following the same procedures as in Example 1. In this case, relative sensitivity of sample 302 was 100.

As is apparent from the results shown in Table 8, the combinations of the present invention have fog much less than and sensitivity much higher than those of the comparative example.

TABLE 8

| | Sensitivity | | | Fog | | | |
|---|---|---|---|---|---|---|---|
| Sample No. | B | G | R | B | G | R | Remarks |
| 301 | 81 | 77 | 73 | 0.58 | 0.43 | 0.51 | Comparative Example |
| 302 | 100 | 100 | 100 | 0.16 | 0.13 | 0.14 | Present Invention |
| 303 | 103 | 100 | 100 | 0.16 | 0.13 | 0.14 | " |
| 304 | 100 | 103 | 110 | 0.16 | 0.12 | 0.14 | " |
| 305 | 100 | 104 | 110 | 0.16 | 0.14 | 0.14 | " |
| 306 | 101 | 104 | 110 | 0.16 | 0.14 | 0.14 | " |
| 307 | 100 | 103 | 97 | 0.16 | 0.14 | 0.14 | " |
| 308 | 100 | 103 | 115 | 0.16 | 0.14 | 0.14 | " |
| 309 | 99 | 103 | 105 | 0.16 | 0.14 | 0.14 | " |

EXAMPLE 4

A sample as a multilayered light-sensitive material having the following layers on an undercoated cellulose triacetate film support was formed.

(Composition of Light-Sensitive Layers)

An amount of coating material was measured in g/m$^2$ of silver for the silver halide and colloid silver. Amounts of a coupler, additive, and gelatin were measured in g/m$^2$.

| | |
|---|---|
| Layer 1 (Antihalation layer) | |
| Black Colloid Silver | 0.2 |
| Gelatin | 1.3 |
| Colored Coupler C-1 | 0.06 |
| Ultraviolet Absorbent UV-1 | 0.1 |
| Ultraviolet Absorbent UV-2 | 0.2 |
| Dispersion Oil Oil-1 | 0.01 |
| Dispersion Oil Oil-2 | 0.01 |
| Layer 2 (Interlayer) | |
| Gelatin | 1.0 |
| Colored Coupler C-2 | 0.02 |
| Dispersion Oil Oil-1 | 0.1 |
| Layer 3 (lst Red-Sensitive Emulsion Layer) | |
| Emulsion (401) listed in Table 9 | |
| silver | 1.0 |
| Gelatin | 0.8 |
| Coupler C-3 | 0.48 |
| Coupler C-4 | 0.56 |
| Coupler C-8 | 0.08 |
| Coupler C-2 | 0.08 |
| Coupler C-5 | 0.04 |
| Dispersion Oil Oil-1 | 0.30 |
| Dispersion Emulsion Oil-3 | 0.04 |
| Layer 4 (2nd Red-Sensitive Emulsion Layer) | |
| Emulsion (402) listed in Table 9 | |
| silver | 1.0 |
| Gelatin | 1.0 |
| Coupler C-6 | 0.05 |
| Coupler C-7 | 0.1 |
| Dispersion Oil Oil-1 | 0.01 |
| Dispersion Oil Oil-2 | 0.05 |
| Layer 5 (Interlayer) | |
| Gelatin | 1.0 |
| Compound Cpd-A | 0.03 |
| Dispersion Oil Oil-1 | 0.05 |
| Layer 6 (1st Green-Sensitive Emulsion Layer) | |
| Emulsion (403) listed in Table 9 | |
| silver | 0.8 |
| Gelatin | 1.0 |
| Coupler C-9 | 0.30 |
| Coupler C-12 | 0.10 |
| Coupler C-1 | 0.06 |
| Coupler C-10 | 0.03 |
| Coupler C-5 | 0.02 |
| Dispersion Oil Oil-1 | 0.4 |
| Layer 7 (2nd Green-Sensitive Emulsion Layer) | |
| Emulsion (404) listed in Table 9 | |
| silver | 0.85 |
| Gelatin | 1.0 |
| Coupler C-11 | 0.01 |
| Coupler C-12 | 0.04 |
| Coupler C-13 | 0.20 |
| Coupler C-1 | 0.02 |
| Coupler C-15 | 0.02 |
| Dispersion Oil Oil-1 | 0.20 |
| Dispersion Oil Oi-2 | 0.05 |
| Layer 8 (Interlayer) | |
| Gelatin | 1.2 |
| Compound Cpd-B | 0.1 |
| Dispersion Oil Oil-1 | 0.3 |
| Layer 9 (lst Blue-Sensitive Emulsion Layer) | |
| Emulsion (405) listed in Table 9 | |
| silver | 0.4 |

-continued

| | |
|---|---|
| Gelatin | 1.0 |
| Coupler C-14 | 0.9 |
| Coupler C-5 | 0.07 |
| Dispersion Oil Oil-1 | 0.2 |
| Layer 10 (2nd Blue-Sensitive Emulsion Layer) | |
| Emulsion (406) listed in Table 9 | |
| silver | 0.5 |
| Gelatin | 0.6 |
| Coupler C-14 | 0.25 |
| Dispersion Oil Oil-1 | 0.07 |
| Layer 11 (lst Protective Layer) | |
| Gelatin | 0.8 |
| Ultraviolet Absorbent UV-1 | 0.1 |
| Ultraviolet Absorbent UV-2 | 0.2 |
| Dispersion Oil Oil-1 | 0.01 |
| Dispersion Oil Oil-2 | 0.01 |
| Layer 12 (2nd Protective Layer) | |
| Gelatin | 0.45 |
| Polymethyl Methacrylate Particles (grain size: 1.5 μm) | 0.2 |
| Hardener H-1 | 0.4 |
| Formaldehyde Scavenger S-1 | 0.5 |
| Formaldehyde Scavenger S-2 | 0.5 |

A surfactant was added as a coating additive to the above-mentioned layers in addition to the components described above.

Names and chemical structures of the compounds used in the present invention are listed in Table 18 to be presented later.

Emulsions (401) to (412) were prepared under the same conditions as emulsion (1), except for the grain formation temperature as is shown in Table 9, and were then optimally, chemically sensitized.

TABLE 9

| Emulsion | Grain Formation Temperature | Thiosulfonate Compound | Sensitizing Dye mol/mol of AgX | Grain Size (μ) | Variation Coefficient (%) |
|---|---|---|---|---|---|
| (401) | 40° C. | — | I $1.0 \times 10^{-4}$<br>II $3.0 \times 10^{-4}$<br>III $1.0 \times 10^{-5}$ | 0.35 | 15 |
| (402) | 76° C. | — | I $5 \times 10^{-5}$<br>II $1.5 \times 10^{-4}$<br>III $5 \times 10^{-6}$ | 0.90 | 10 |
| (403) | 40° C. | — | IV $3.5 \times 10^{-4}$<br>V $1.4 \times 10^{-4}$ | 0.35 | 15 |
| (404) | 76° C. | — | IV $2 \times 10^{-4}$<br>V $7 \times 10^{-5}$ | 0.90 | 10 |
| (405) | 40° C. | — | VI $2 \times 10^{-4}$<br>VII $2 \times 10^{-4}$ | 0.35 | 15 |
| (406) | 76° C. | — | VI $1 \times 10^{-4}$<br>VII $1 \times 10^{-4}$ | 0.90 | 10 |
| (407) | 40° C. | Compound a 5 mg/mol of Ag | The same as (401) | 0.35 | 15 |
| (408) | 76° C. | Compound a 5 mg/mol of Ag | The same as (402) | 0.90 | 10 |
| (409) | 40° C. | Compound a 5 mg/mol of Ag | The same as (403) | 0.35 | 15 |
| (410) | 76° C. | Compound a 5 mg/mol of Ag | The same as (404) | 0.90 | 10 |
| (411) | 40° C. | Compound a 5 mg/mol of Ag | The same as (405) | 0.35 | 15 |
| (412) | 76° C. | Compound a 5 mg/mol of Ag | The same as (406) | 0.90 | 10 |

The samples prepared as described above were used as Sample [A].

Then, samples were prepared by replacing emulsions (401) to (406) with emulsions (407) to (412) listed in Table 9, respectively, and used as Sample [B].

These samples were exposed on the basis of the JIS (Japan Industrial Standard) and then subjected to processing shown in Table 10.

Each sample was processed in an amount of 50 m/day for 16 days while replenishing a processing solution. After each processing solution reached a stationary composition in continuous processing, an ISO sensitivity was measured.

TABLE 10

| Process | Time | Temperature | Replenishing[1] Amount | Tank Volume |
|---|---|---|---|---|
| Color Development | 1 min | 38° C. | 10 ml | 4 |
| Bleach-Fixing | 1 min | 38° C. | 20 ml | 4 |
| Washing (1) | 15 sec. | 38° C. | Counter current flow replenishment from (2) to (1) 10 ml | 2 |
| Washing (2) | 15 sec. | 38° C. | | 2 |
| Drying | 30 sec. | 65° C. | | |

[1]A replenishing amount per meter of a 35-mm wide sample.

The compositions of the process solutions (mother and replenishment solutions) are represented as follows:

| Color Developing Solution (g) | Mother Solution | Replenishment Solution |
|---|---|---|
| Water | 900 ml | 900 ml |
| Potassium Chloride | 1.0 | 1.0 |
| Potassium Carbonate | 34.6 | 38.0 |
| Sodium Bicarbonate | 1.8 | 2.0 |
| Ethylenediamine-N—N,N,N-tetramethylenephosphonic acid | 1.0 | 1.2 |
| Triethylenediamine-(1,4-diazabicyclo[2,2]-octane | 5.3 | 6.0 |
| Diethylhydroxylamine | 4.2 | 5.5 |
| 3-methyl-4-amino-N-ethyl-N-β-hydroxyethylanilinesulfate | 4.6 | 7.5 |
| Potassium hydroxide to make | pH 10.05 | pH 10.15 |
| Water to make | 1.0 l | 1.0 l |

| Bleach-Fixing Solution | Mother and replenishment solutions are common (g) |
|---|---|
| Ferric Ammonium Ethylenediaminetetraacetate (Dihydrate) | 90.0 |

-continued

| | |
|---|---|
| Disodium Ethylenediaminetetraacetate | 10.0 |
| Sodium Sulfite | 12.0 |
| Ammonium Thiosulfate Aqueous Solution (70%) | 260.0 ml |
| Acetic Acid (98%) | 5.0 ml |
| Bleaching Accelerator | 0.01 mol |

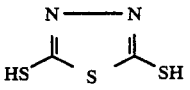

| | |
|---|---|
| Water to make | 1.0 l |
| pH | 6.0 |

| Washing Solution | Mother and replenishment solutions are common |
|---|---|
| Ion Exchange Water (obtained by supplying tap water to a mixed-bed column filled with an H type strongly acidic cation exchange resin (DIA ION SK-1B availabe from Mitsubishi Chemical Industries Ltd.) and an OH type strongly basic anion exchange resin (DIA ION SA-10A available from Mitsubishi Chemical Industries Ltd.) at a volume ratio of 1:15 to set the concentrations of calcium and magnesium to be 3 mg/l or less) | 1 l |
| Sodium Dichloroisocyanurate | 20 mg |
| Sodium Sulfate | 150 mg |
| Polyoxyethylene-p-monononylphenylether (average degree of polymerization: 10) | 300 mg |
| pH | 6.5 to 7.5 |

After the processing solution composition reached a running equilibrium by the above processing, samples similar to those subjected to the continuous processing were exposed on the basis of the JIS and then processed by the above processing solution.

As a result of calculating the ISO sensitivity of a processed film on the basis of the JIS, Sample [B] had ISO 50 while Sample [A] had ISO 25. Thus, the advantage of the present invention were attained.

EXAMPLE 5

The processing in Example 4 was performed following the same procedures as in Example 4, except that the conditions were changed as shown in Table 11 and the processing solution composition was changed as follows.

In this case, too, the advantages of the present invention were attained.

TABLE 11

| Process | Time | Temperature | Replenishing[1] Amount | Tank Volume |
|---|---|---|---|---|
| Color Development | 30 sec. | 42° C. | 20 ml | 4 liter |
| Bleach-Fixing | 30 sec. | 42° C. | 20 ml | 4 liter |
| Washing (1) | 10 sec. | 42° C. | Counter current flow replenishment from (2) to (1) | 2 liter |
| Washing (2) | 10 sec. | 42° C. | | 2 liter |
| Drying | 30 sec. | 65° C. | 10 ml | |

[1]A replenishing amount per meter of a 35-mm wide sample.

The compositions of the process solutions (mother and replenishment solutions) are represented as follows:

| Color Developing Solution (g) | Mother Solution | Replenishment Solution |
|---|---|---|
| Water | 900 ml | 900 ml |
| Potassium Chloride | 2.0 | 2.0 |
| Potassium Carbonate | 34.6 | 38.0 |
| Sodium Bicarbonate | 1.0 | 1.5 |
| Ethylenediamine-N—N,N,N-tetramethylenephosphonic acid | 2.0 | 2.4 |
| Triethylenediamine-(1,4-diazabicyclo[2,2,2]-octane | 5.3 | 6.0 |
| Diethylhydroxylamine | 4.2 | 5.5 |
| 3-methyl-4-amino-N-ethyl-N-β-hydroxyethylanilinesulfate | 6.0 | 8.0 |
| Potassium hydroxide to make | pH 10.2 | pH 10.3 |
| Water to make | 1.0 l | 1.0 l |

| Bleach-Fixing Solution | Mother Solution | Replenishment Solution |
|---|---|---|
| Water | 600 ml | 600 ml |
| Ferric Ammonium Ethylenediaminetetraacetate (Dihydrate) | 90.0 | 100.0 |
| Disodium Ethylenediaminetetraacetate | 10.0 | 10.0 |
| Sodium Sulfite | 10.0 | 12.0 |
| Ammonium Thiosulfate Aqueous Solution (70%) | 260.0 ml | 270.0 ml |
| Bleaching Accelerator | 0.01 mol | 0.015 mol |

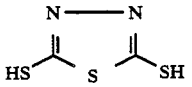

| | | |
|---|---|---|
| Acetic Acid to make | pH 5.5 | pH 5.0 |
| Water to make | 1.0 l | 1.0 l |

| Washing Solution | Mother and replenishment solutions are common |
|---|---|
| Ion Exchange Water (obtained by supplying tap water to a mixed-bed column filled with an H type strongly acidic cation exchange resin (DIA ION SK-1B available from Mitsubishi Chemical Industries Ltd.) and an OH type strongly basic anion exchange resin (DIA ION SA-10A) available from Mitsubishi Chemical Industries Ltd.) at a volume ratio of 1:1.5 to set the concentrations of calcium and magnesium to be 3 mg/l or less) | 1 l |
| Sodium Dichloroisocyanurate | 20 mg |
| Sodium Sulfate | 150 mg |
| Polyoxyethylene-p-monononylphenylether (average degree of polymerization: 10) | 300 mg |
| pH | 6.5 to 7.5 |

EXAMPLE 6

The processing in Example 4 was performed following the same procedures as in Example 4 except that the conditions were changed as shown in Table 12 and the processing solution composition was changed as follows. In this case, too, the advantages of the present invention were attained.

TABLE 12

| | |
|---|---|
| Color Developent | 2 min. 15 sec. |
| Bleaching | 6 min. 30 sec. |
| Washing | 2 min. 10 sec. |
| Fixing | 4 min. 20 sec. |
| Washing | 3 min. 15 sec. |

TABLE 12-continued

| Stabilizing | 1 min. 05 sec. |
|---|---|
| Color Developing Solution | |
| Diethylenetriaminepentaacetic Acid | 1.0 g |
| 1-hydroxyethylidene-1,1-diphosphonic acid | 2.0 g |
| Sodium Sulfite | 4.0 g |
| Potassium Carbonate | 30.0 g |
| Potassium Bromide | 1.4 g |
| Hydroxyamine Sulfate | 2.4 g |
| 4-(N-ehyl-N-β-hydroxyethylamino)-2-methylanilinesulfate | 4.5 g |
| Water to make | 1.0 l |
| | pH 10.0 |
| Breaching Solution | |
| Ferric Ammonium Ethylenediaminetetraacetate (Dihydrate) | 100.0 g |
| Disodiium Ehylenediaminetetraacetate | 10.0 g |
| Ammonium Bromide | 150.0 g |
| Ammonium Nitrate | 10.0 g |
| Water to make | 1.0 l |
| | pH 6.0 |
| Fixing Solution | |
| Disodium Ethylenediaminetetraacetate | 1.0 g |
| Sodium Sulfite | 4.0 g |
| Ammonium Thiosulfate Aqueous Solution (70%) | 175.0 ml |
| Sodium Bisulfite | 4.6 g |
| Water to make | 1.0 l |
| | pH 6.6 |
| Stabilizing Solution | |
| Formalin (40%) | 2.0 ml |
| Polyoxyethylene-p-monononyl-phenylether (average polymerization degree: 10) | 0.3 g |
| Water to make | 1.0 l |

TABLE 13

XX-1

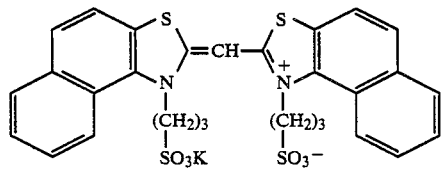

XX-2

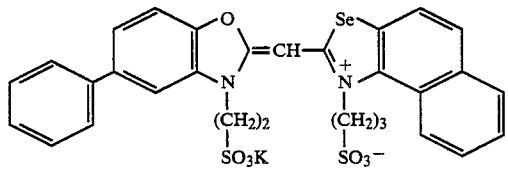

XX-3

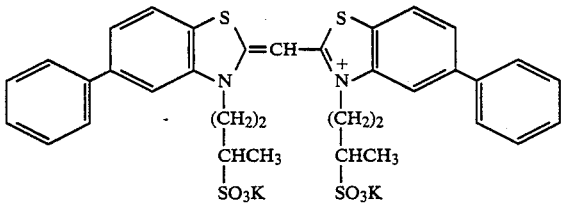

XX-4

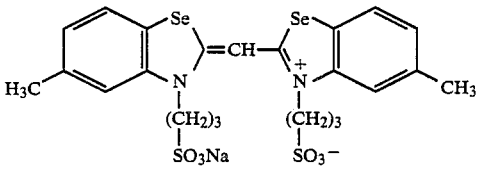

XX-5

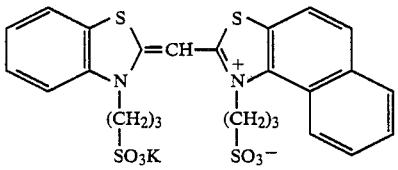

XX-6

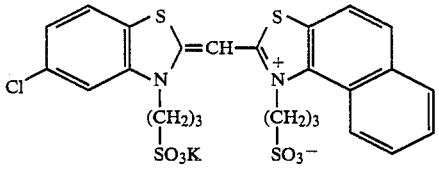

TABLE 13-continued
XX-7
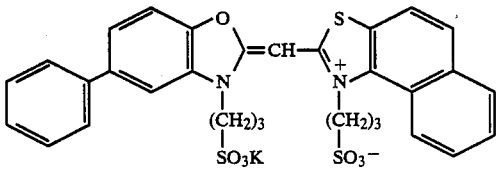
XX-8
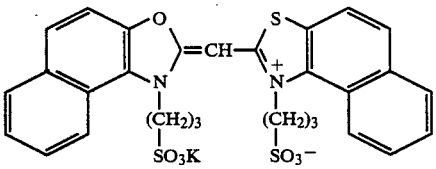
XX-9
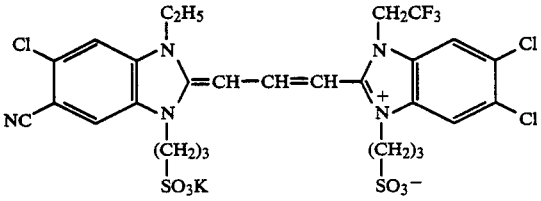
XX-10
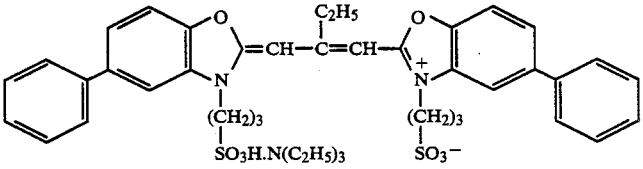
XX-11
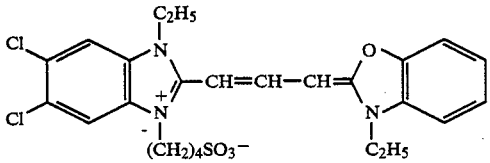
XX-12
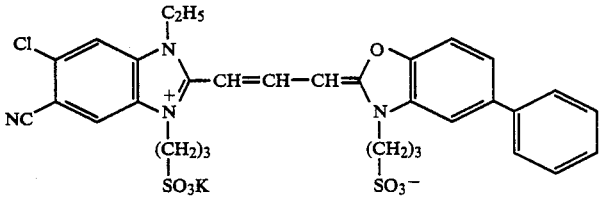
XX-13
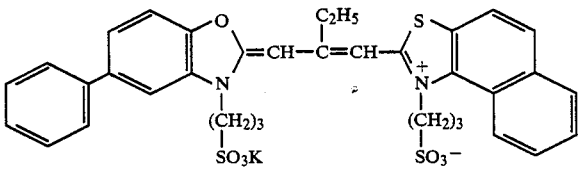
XX-14
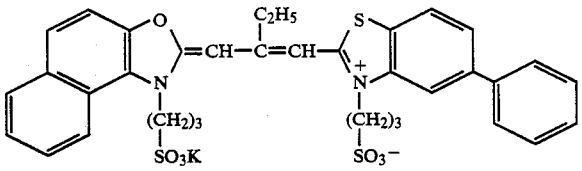

TABLE 13-continued
XX-15
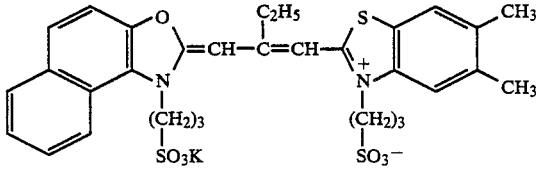
XX-16
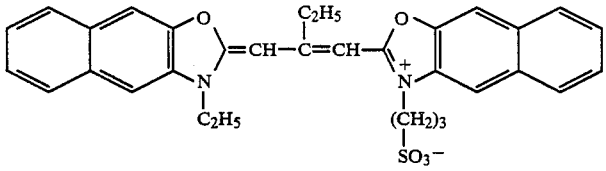
XX-17
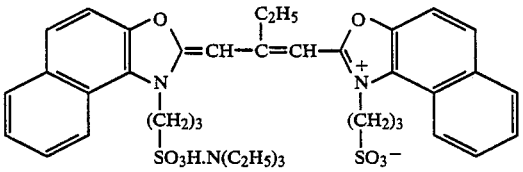
XX-18
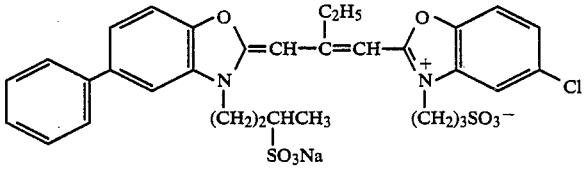
XX-19
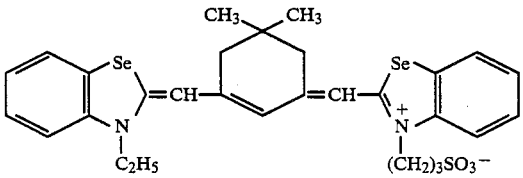
XX-20
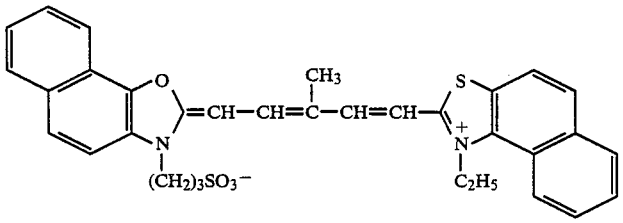
XX-21
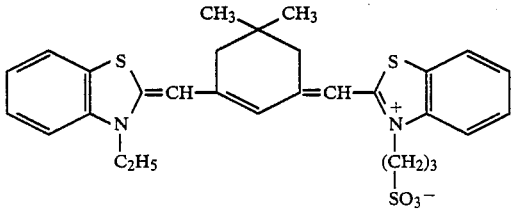
XX-22
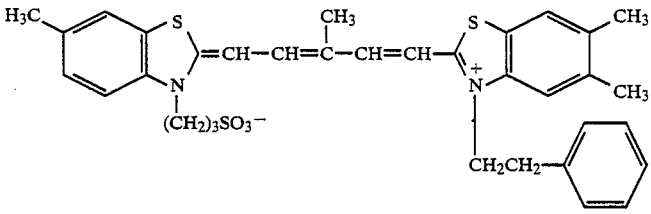

TABLE 13-continued
XX-23
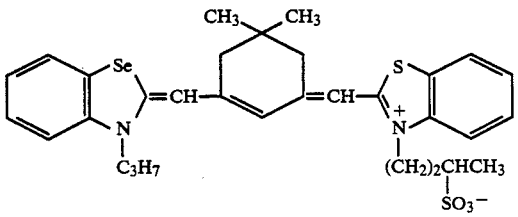
XX-24
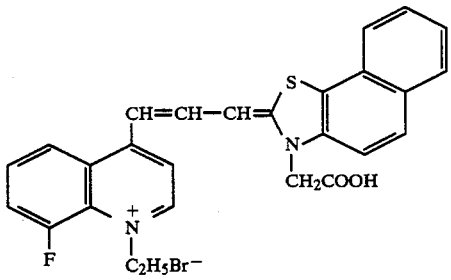
XX-25
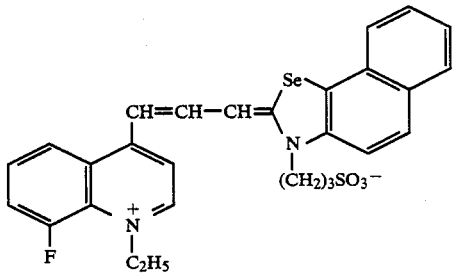
XX-26
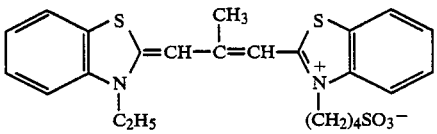
XX-27
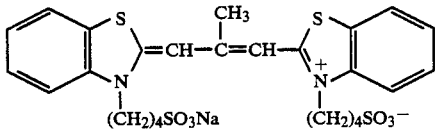
XX-28
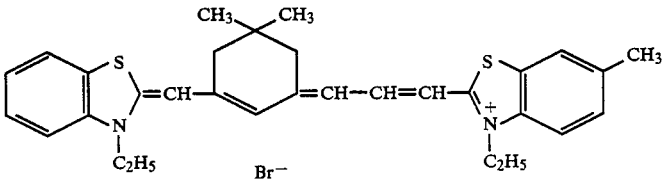
XX-29
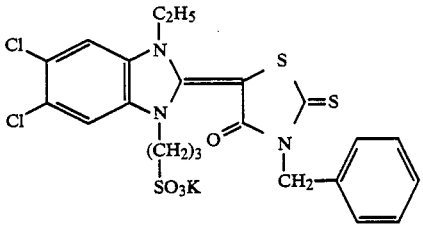

TABLE 13-continued
XX-30
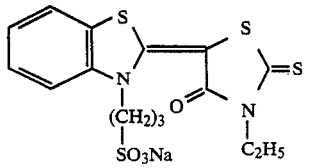
XX-31
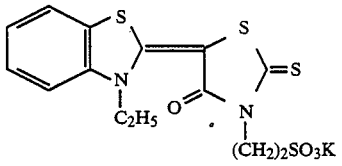
XX-32
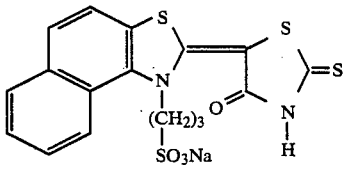
XX-33
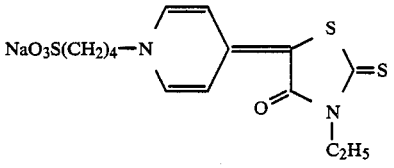
XX-34
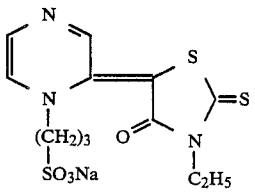
XX-35
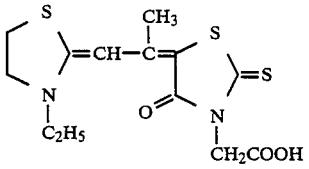
XX-36
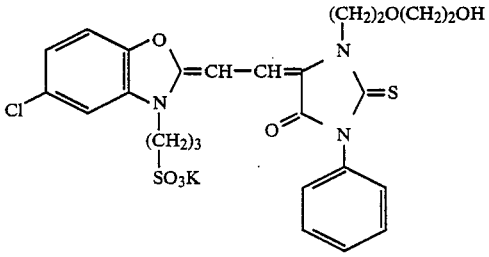
XX-37
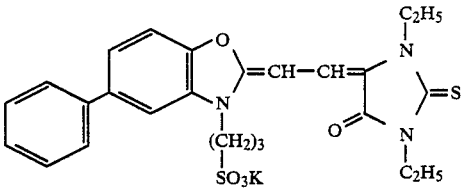

TABLE 13-continued
XX-38
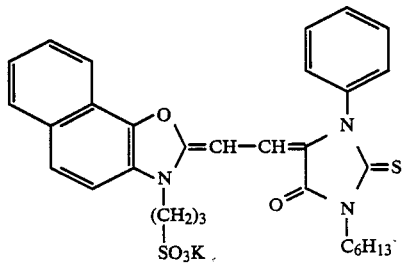
XX-39
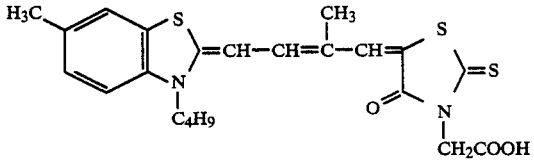
XX-40
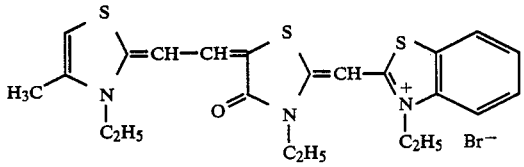
XX-41
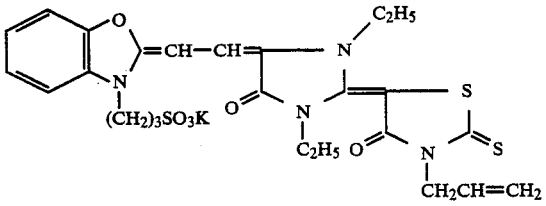
TABLE 14
XXI-1
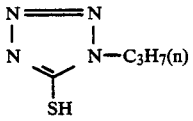
XXI-2
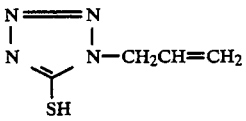
XXI-3
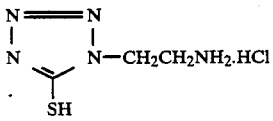
XXI-4
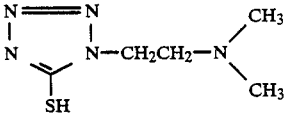
XXI-5
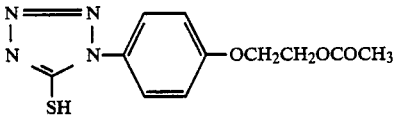
TABLE 14-continued
XXI-6
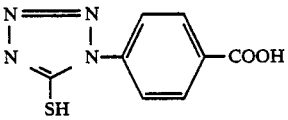
XXI-7
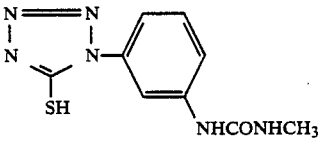
XXI-8
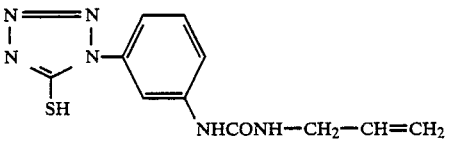
XXII-1
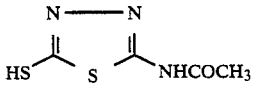
XXII-2
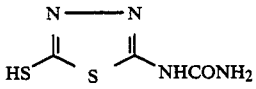

TABLE 14-continued
XXII-3
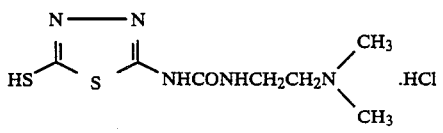
XXII-4
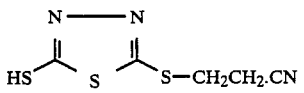
XXII-5
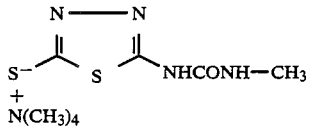
TABLE 14-continued
XXIII-1
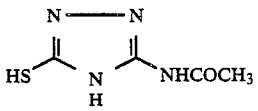
XXIII-2
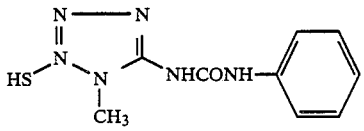
TABLE 15
C-1
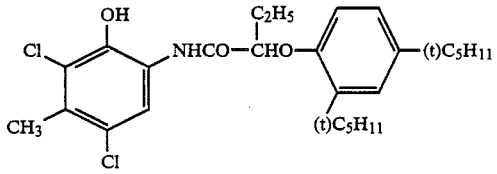
C-2
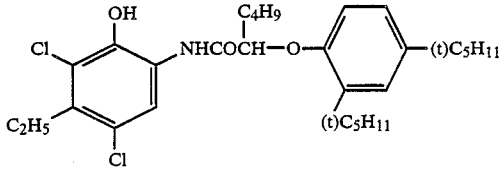
C-3
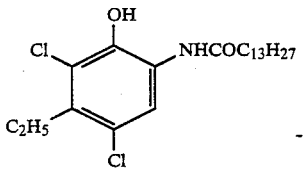
C-4
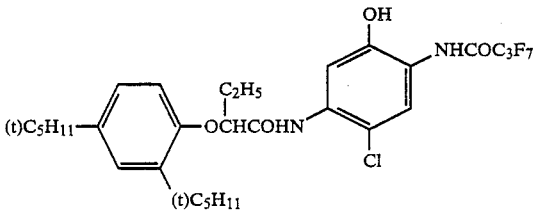
C-5
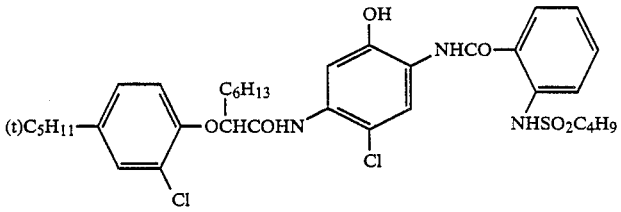

TABLE 15-continued
C-6
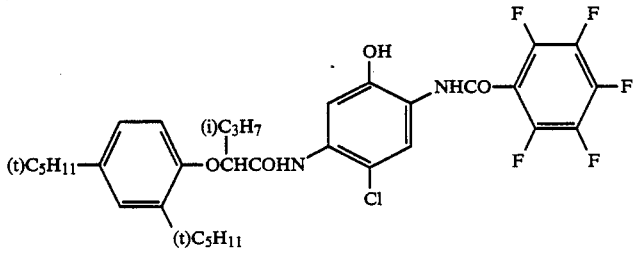
C-7
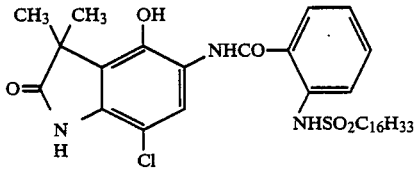
C-8
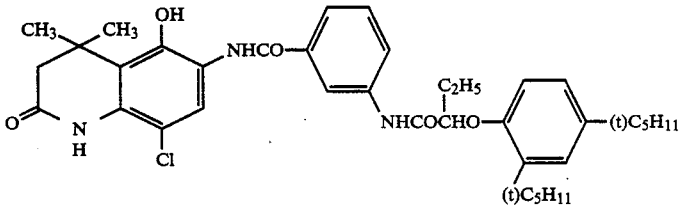
C-9
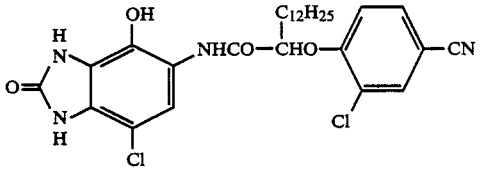
C-10
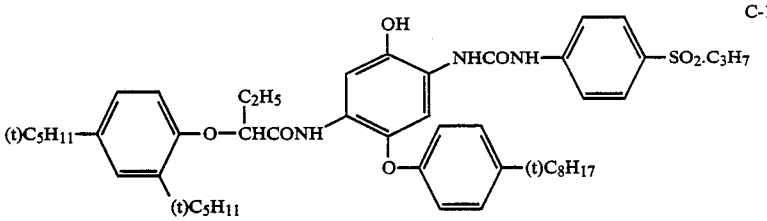
C-11
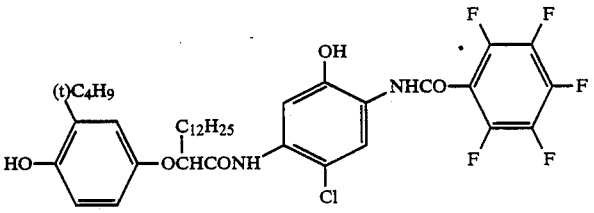
M-1
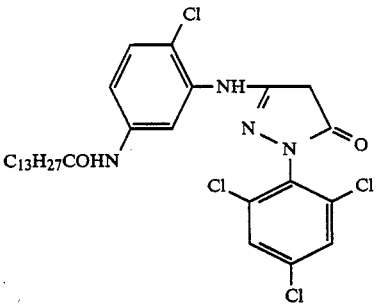

TABLE 15-continued
M-2
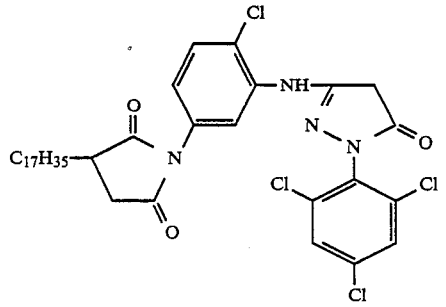
M-3
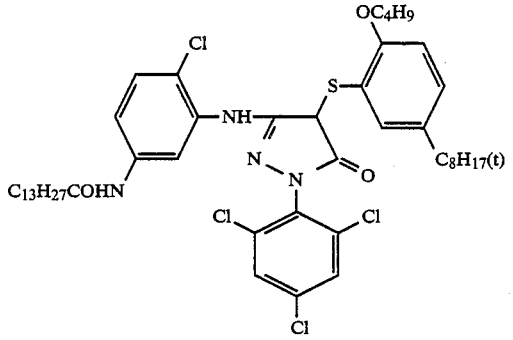
M-4
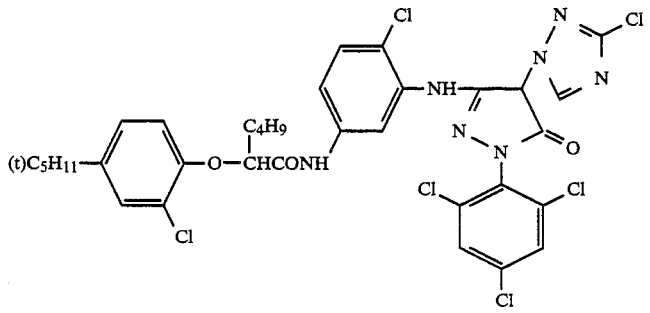
M-5
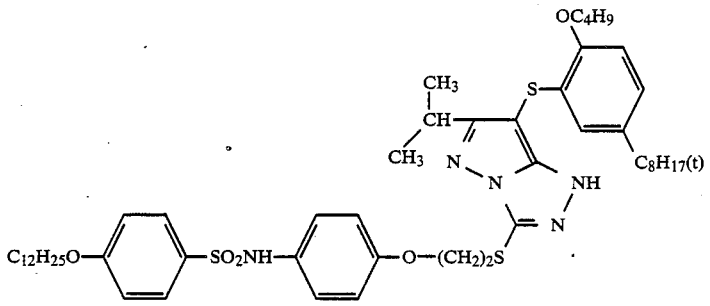
M-6
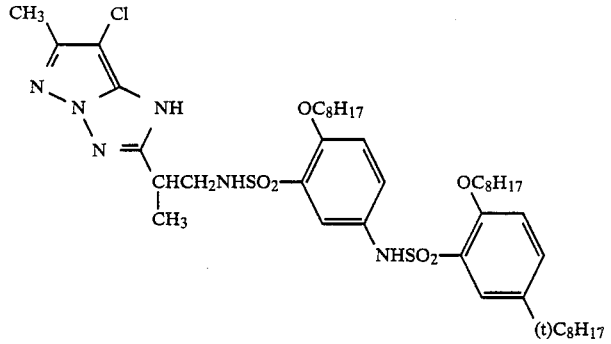

TABLE 15-continued
M-7
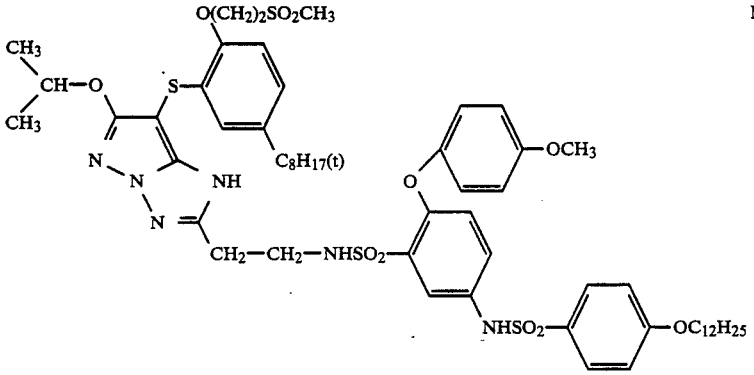
M-8
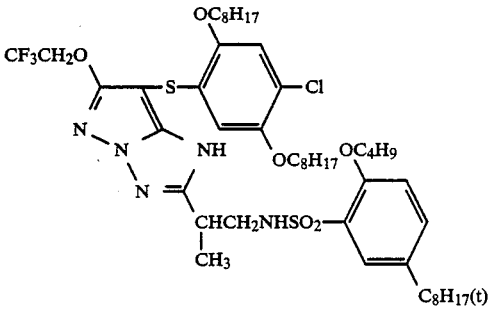
M-9
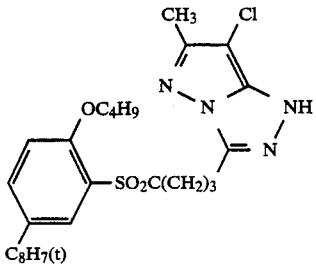
Y-1
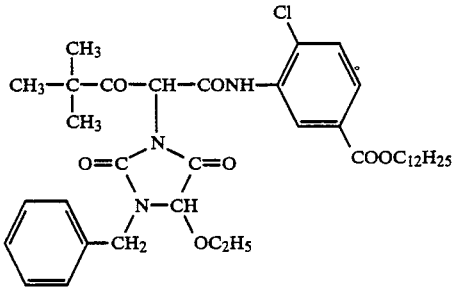
Y-2
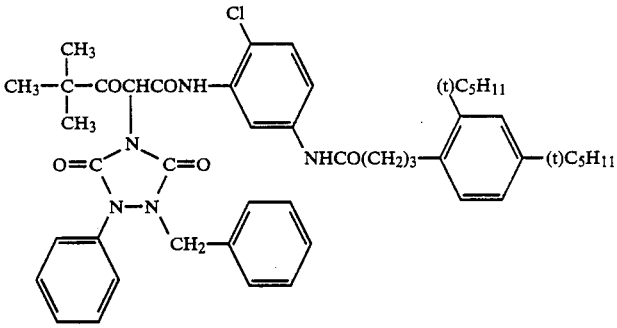

TABLE 15-continued
Y-3
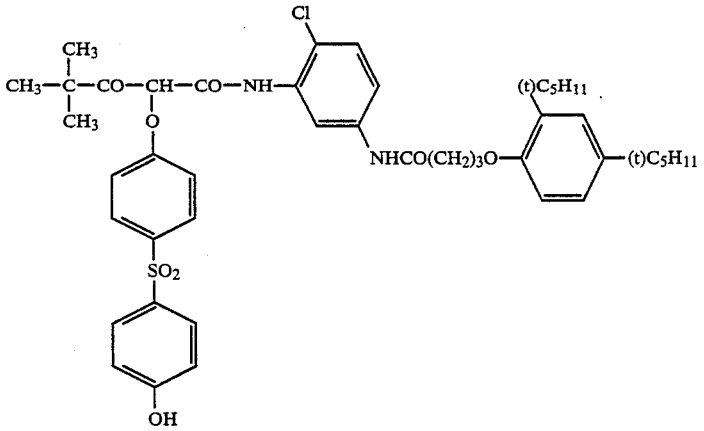
Y-4
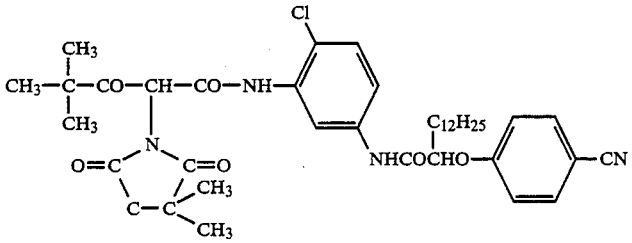
Y-5
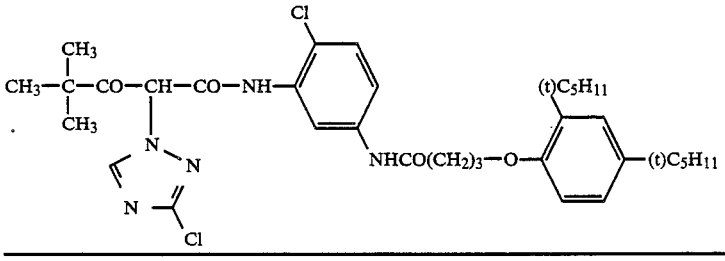
TABLE 16
Mazenta Coupler ExM1
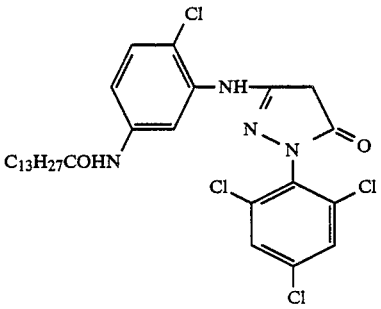
Dye Image Stabilizer Cpd-3
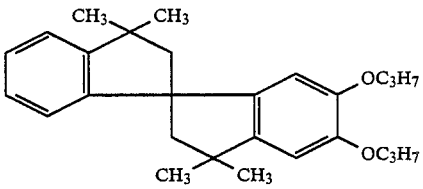
Dye Image Stabilizer Cpd-4
TABLE 16-continued
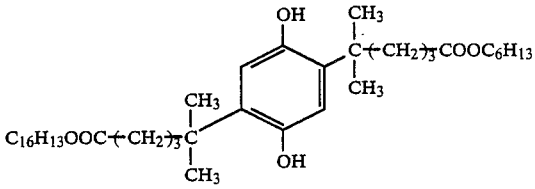
Solvent Solv-2
1:1 mixture (volume ratio) of:
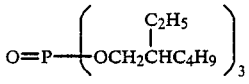
and
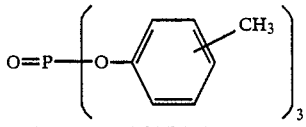

TABLE 17
Yellow Coupler
ExY
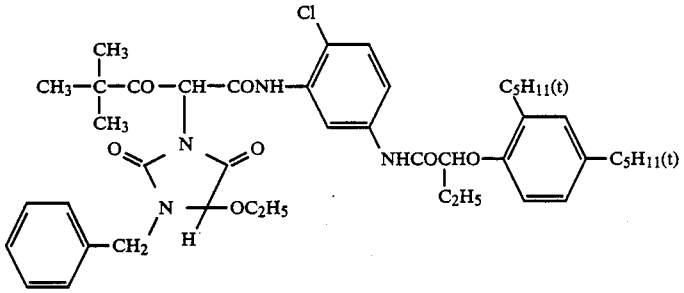
Mazenta Couplers
ExM1
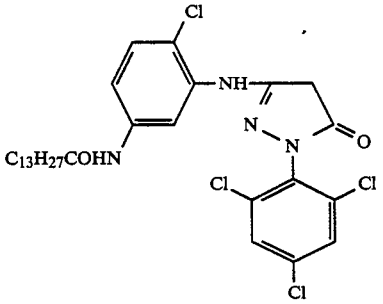
ExM2
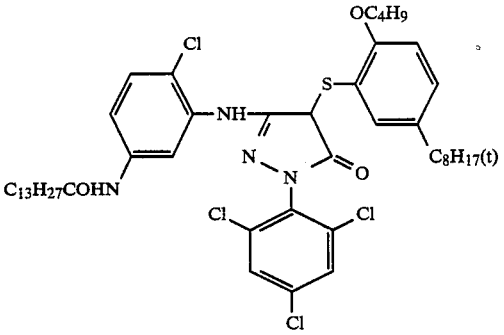
ExM3
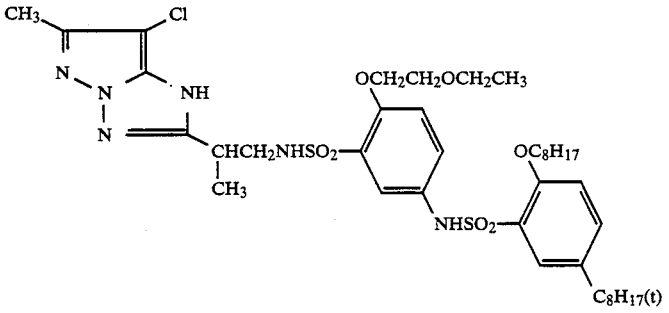
ExM4

TABLE 17-continued
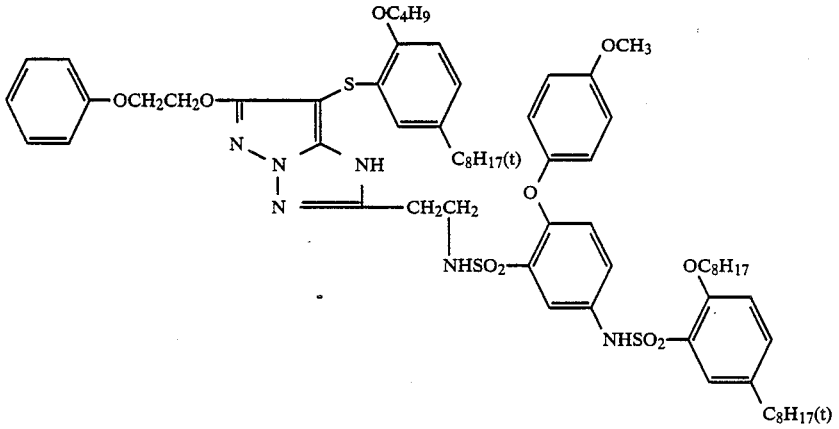
Cyan Couplers
ExC1
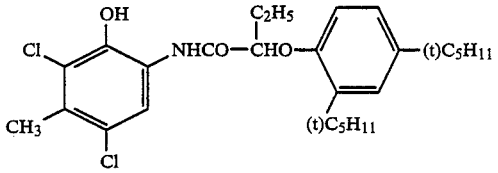
ExC2
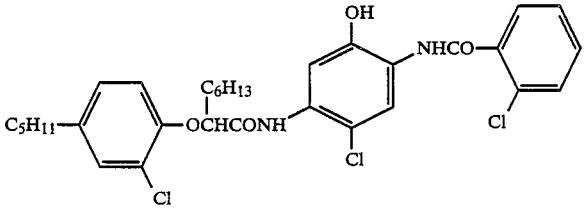
ExC3
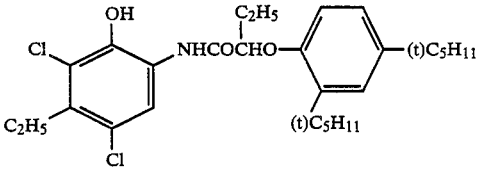
ExC4
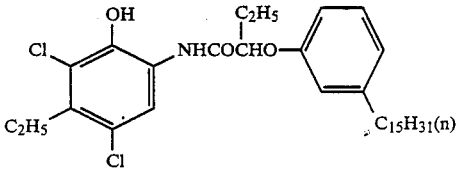
ExC5
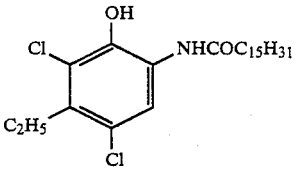
Dye Image Stabilizer Cpd-1

TABLE 17-continued
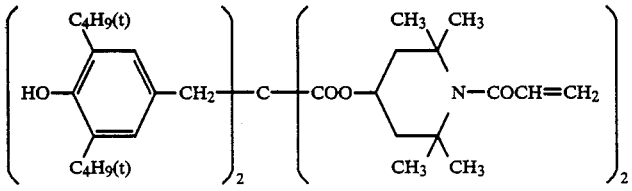
Color Mixing Inhibitor Cpd-2
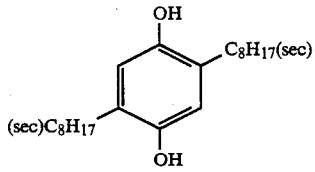
Dye Image Stabilizer Cpd-3
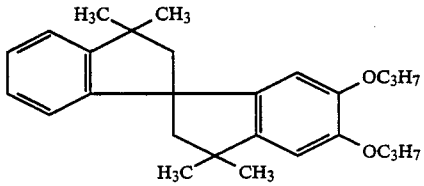
Dye Image Stabilizer Cpd-4
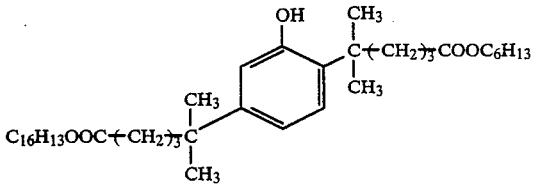
Color Mixing Inhibitor Cpd-5
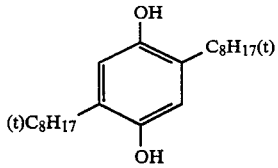
Dye Image Stabilizer Cpd-6
5:8:9 mixture (weight ratio) of:
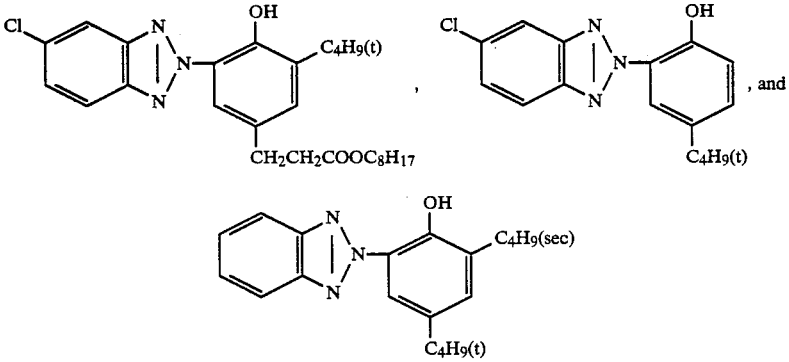
Polymer Cpd-7
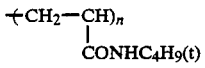
(Mean Molecular Weight 80,000)

TABLE 17-continued
Ultraviolet Absorbent UV-1
2:9:8 mixture (weight ratio) of:
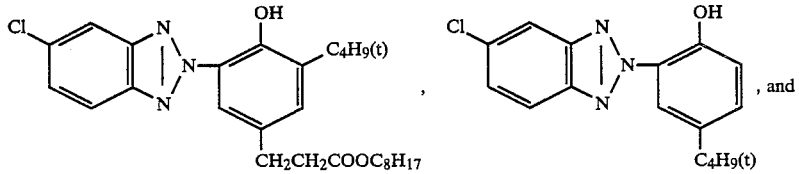
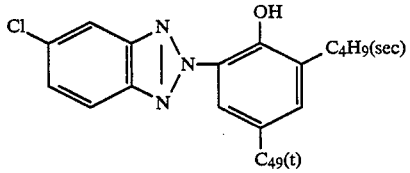
Solvent Solv-1
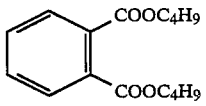
Solvent Solv-3
$O{=}P{\leftarrow}O{-}C_9H_{19}(iso))_3$
Solvent Solv-4
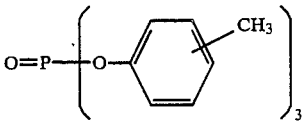
Compound Ex-3a
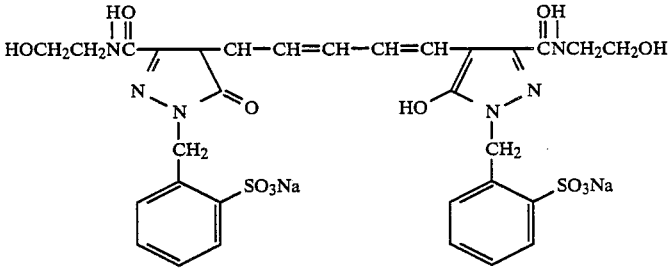
Compound Ex-3b
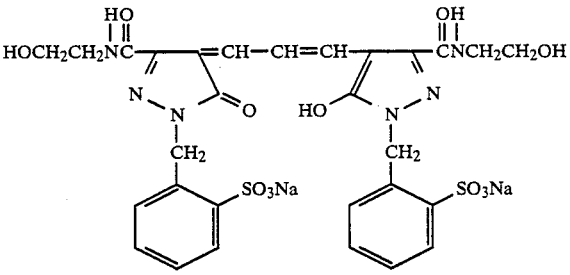
Compound Ex-3c TABLE 17-continued
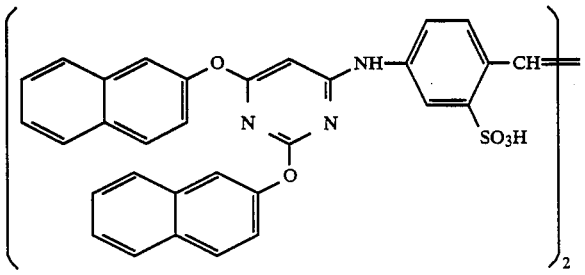
Compound Ex-3d
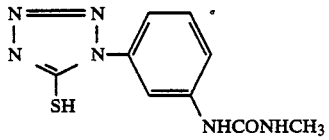
Ex Dye B
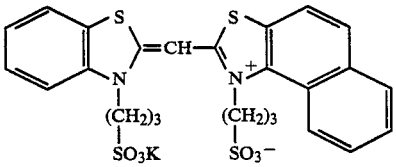
Ex Dye G
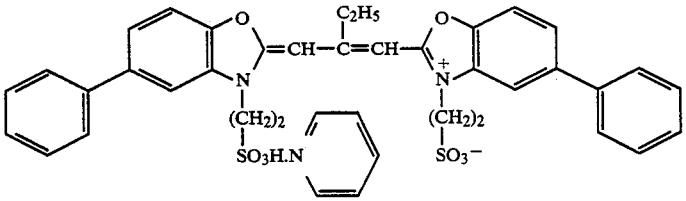
Ex Dye R
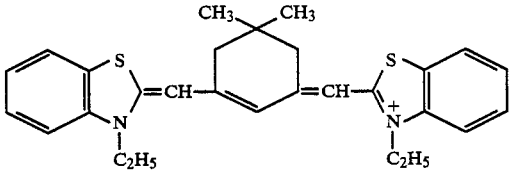
TABLE 18
UV-1
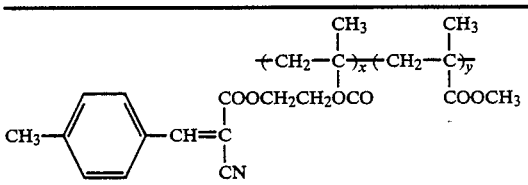
x/y = 7/3 (weight ratio)
UV-2
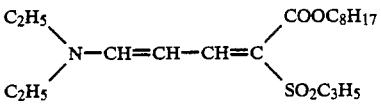
Oil-1 tricresyl Phosphate
Oil-2 dibutyl phtalate
Oil-3 bis(2-ethylhexyl)phtalate TABLE 18-continued
C-1
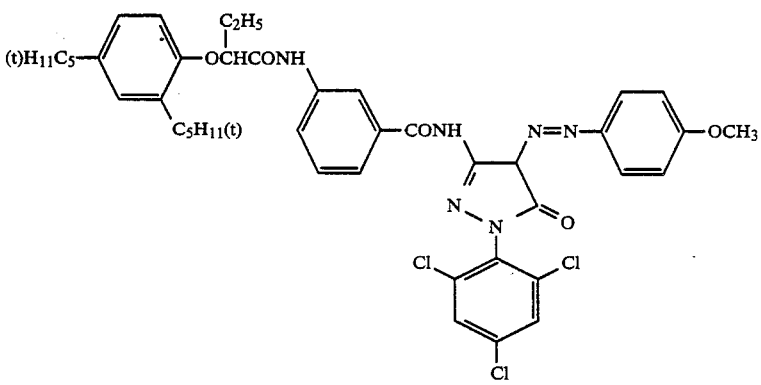
C-2
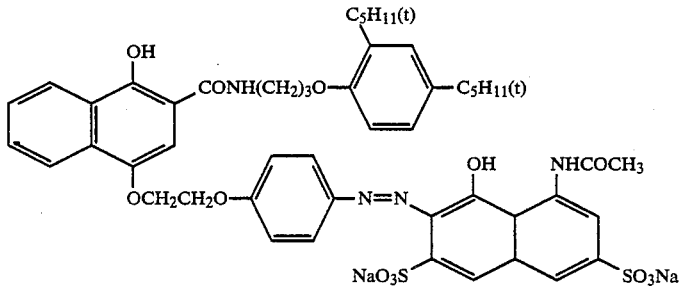
C-3
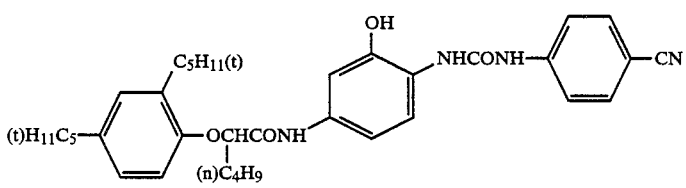
C-4
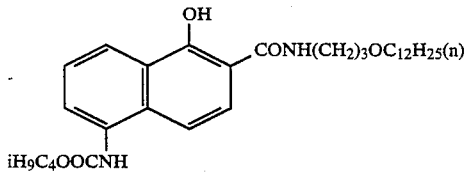
C-5
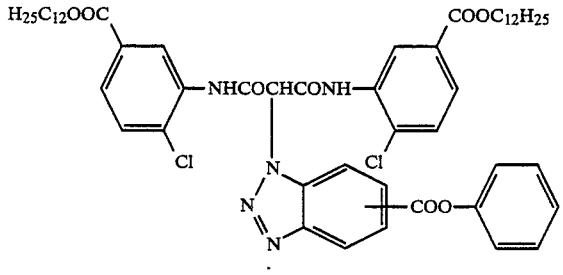
C-15
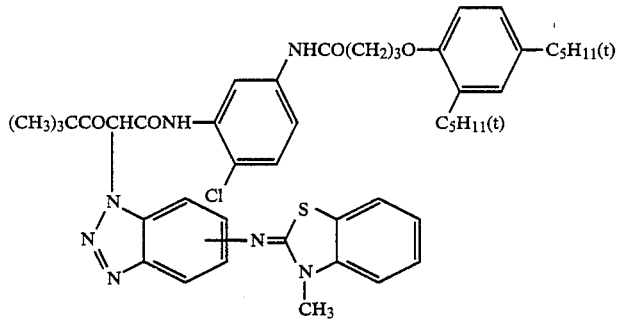

TABLE 18-continued
C-6
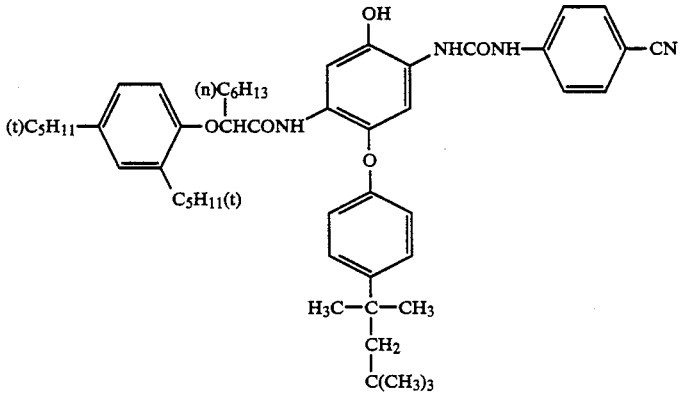
C-7
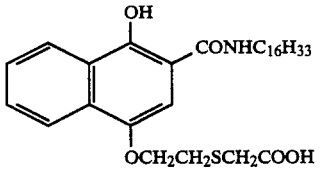
C-8
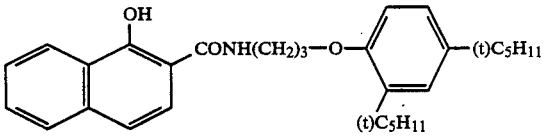
C-9
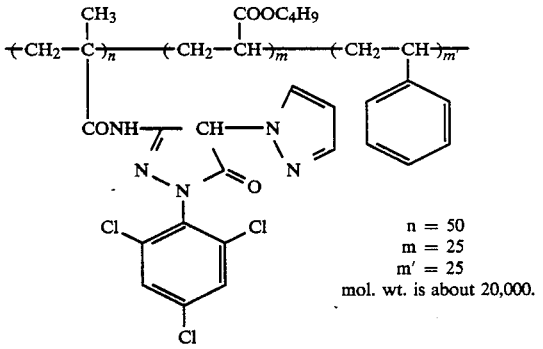
n = 50
m = 25
m' = 25
mol. wt. is about 20,000.
C-10
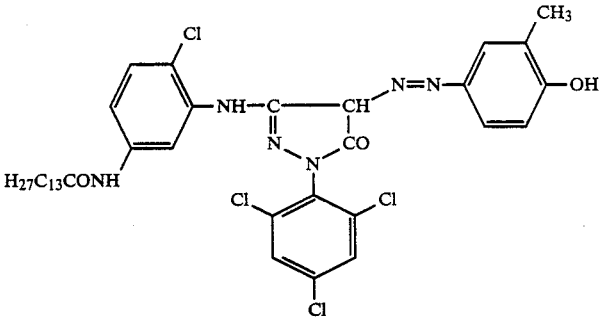

TABLE 18-continued
C-11
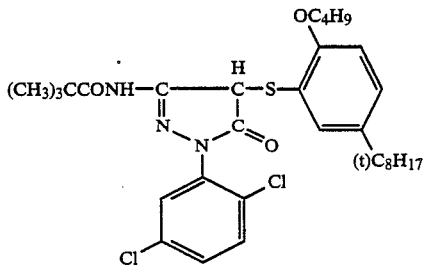
C-12
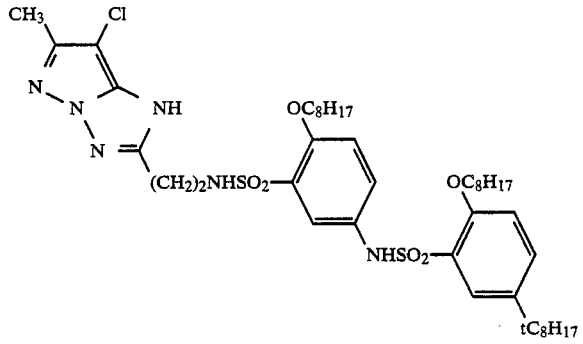
C-13
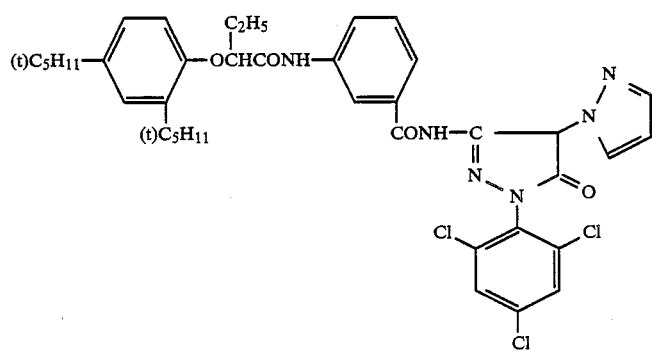
C-14
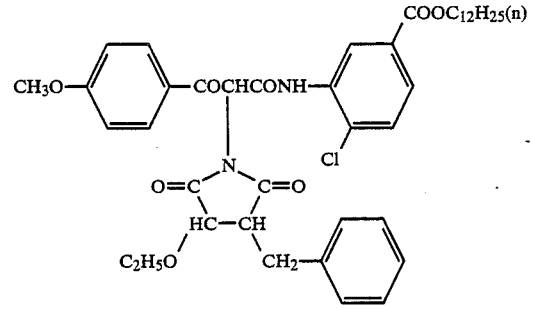
Cpd A
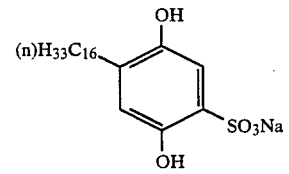
Cpd B
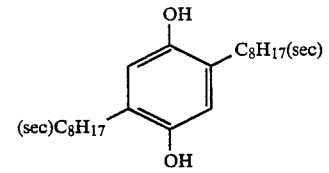

TABLE 18-continued
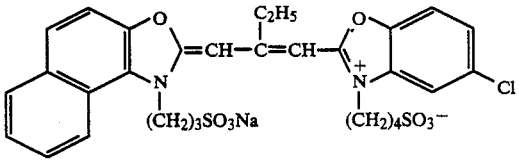
Sensitizing dye I
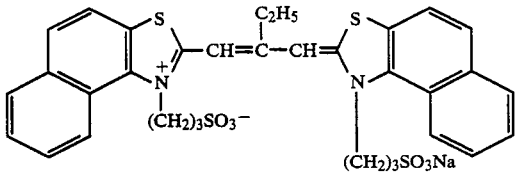
Sensitizing dye III
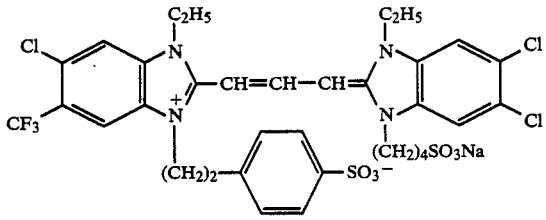
Sensitizing dye V
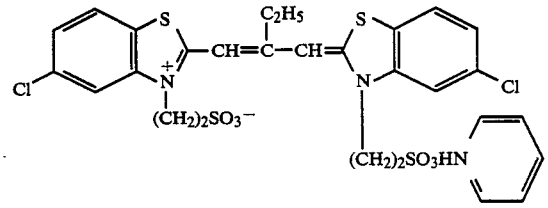
Sensitizing dye II
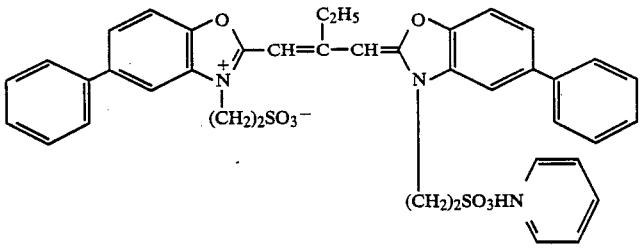
Sensitizing dye IV
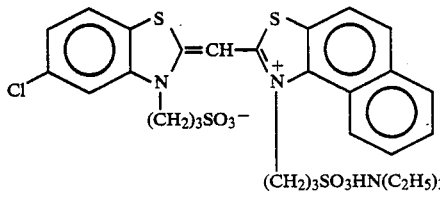
Sensitizing dye VI
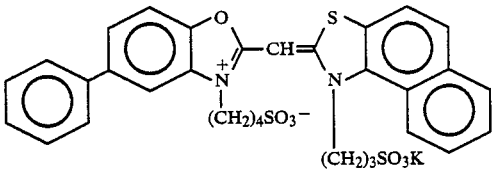
Sensitizing dye VII
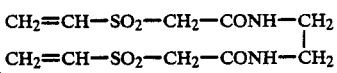
H-1

TABLE 18-continued

| | |
|---|---|
| 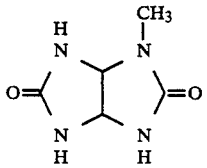 | S-1 |
| 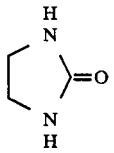 | S-2 |

What is claimed is:

1. A silver halide color photographic light-sensitive material comprising a support having thereon at least one silver halide emulsion layer, wherein said emulsion layer contains a silver halide emulsion which comprises silver halide grains consisting of at least 95 mol % of silver chloride and which is chemically sensitized in the presence of at least one of the compounds represented by formulas (I) to (III):

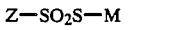

Formula [I]

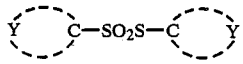

Formula [II]

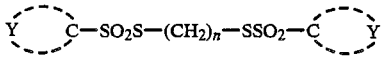

Formula [III]

wherein z represents alkyl having 1 to 18 carbon atoms, aryl having 6 to 18 carbon atoms, or heterocyclic, Y represents an atom group required for forming heterocyclic or aryl having 6 to 18 carbon atoms, M represents a metal cation, an organic cation, or a hydrogen atom, and n represents an integer from 2 to 10;

said silver halide grains are spectrally sensitized by at least one of the sensitizing dyes represented by formulas (XXa), (XXb), and (XXc), where Formula (XXa)

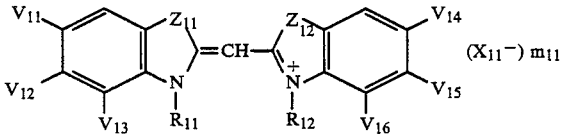

wherein $Z_{11}$ represents oxygen, sulfur, or selenium, $Z_{12}$ represents sulfur or selenium;

$R_{11}$ and $R_{12}$ each represent alkyl or alkenyl which is either substituted or unsubstituted and has six carbon atoms or less; with the provisos that at least one of $R_{11}$ or $R_{12}$ represents sulfo-substituted alkyl; and when $Z_{11}$ represents oxygen, $V_{11}$ and $V_{13}$ represent hydrogen, and $V_{12}$ represents phenyl, alkyl having 3 carbon atoms or less or alkoxy having 3 carbon atoms or less or phenyl substituted with chlorine, or that $V_{11}$ and $V_{12}$, or $V_{12}$ and $V_{13}$ can be coupled to form a condensed benzene ring; and when $Z_{11}$ represents sulfur or selenium, $V_{11}$ represents alkyl or alkoxy each having four carbon atoms or less, or hydrogen, $V_{12}$ represents alkyl having five carbon atoms or less, alkoxy having four carbon atoms or less, chlorine, hydrogen, substituted or unsubstituted phenyl or hydroxyl, and $V_{13}$ represents hydrogen, or that $V_{11}$ and $V_{12}$, or $V_{12}$ and $V_{13}$ can be coupled to form a condensed benzene ring; and when $Z_{12}$ represents selenium, $V_{14}$, $V_{15}$, and $V_{16}$ represent the same meanings as those represented by $V_{11}$, $V_{12}$, $V_{13}$ when $Z_{11}$ represents selenium, respectively; and when $Z_{12}$ represents sulfur and $Z_{11}$ represents selenium, $V_{14}$ represents hydrogen, alkoxy having four carbon atoms or less, or alkyl having five carbon atoms or less, $V_{15}$ represents alkoxy having four carbon atoms or less, substituted or unsubstituted phenyl, alkyl having four carbon atoms or less, chlorine, or hydroxyl, and $V_{16}$ represents hydrogen, or that $V_{14}$ and $V_{15}$, or $V_{15}$ and $V_{16}$ can be coupled to form a condensed benzene ring; and when both $Z_{11}$ and $Z_{12}$ represent sulfur, $V_{14}$ and $V_{16}$ represent hydrogen, and $V_{15}$ represents substituted or unsubstituted phenyl, or that $V_{14}$ represents hydrogen and $V_{15}$ and $V_{16}$ can be coupled to form a condensed benzene ring; and when $Z_{11}$ represents oxygen and $Z_{12}$ represents sulfur, $V_{14}$ and $V_{16}$ represent hydrogen, and $V_{15}$ represents chlorine, substituted or unsubstituted phenyl or alkoxy having four carbon atoms or less, or that $V_{15}$ and $V_{16}$ can be coupled to form a condensed benzene ring;

$X^-_{11}$ represents an anion residue of an acid; and $m_{11}$ represents 0 or 1;

Formula (XXb)

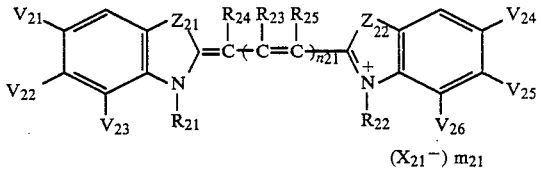

wherein $Z_{21}$ and $Z_{22}$ can be the same or different and represent oxygen, sulfur, selenium or N-$R_{26}$;

$R_{21}$ and $R_{22}$ represent the same meanings as those represented by $R_{11}$ and $R_{12}$ of formula (XXa), and also represent that $R_{21}$ and $R_{24}$ or $R_{22}$ and $R_{25}$ can be coupled to form a 5- or 6-membered carbon ring; with the provisos that when $n_{21}$ represents 2 or 3, $R_{21}$ and $R_{22}$ do not represent a substituting group having sulfo at the same time;

when at least one of $Z_{21}$ and $Z_{22}$ represents N-$R_{26}$, $R_{23}$ represents hydrogen, and otherwise, represents lower alkyl or phenethyl;

when $n_{21}$ represents 2 or 3, $R_{23}$ represents lower alkyl on phenethyl and $R_{23}$ can be coupled to form a 5- or 6-membered ring;

$R_{24}$ and $R_{25}$ represent hydrogen;

$R_{26}$ and $R_{27}$ represent the same meanings as that represented by $R_{21}$ or $R_{22}$, with the provisos that $R_{21}$ and $R_{26}$ do not represent a substituting group having sulfo at the same time and that $R_{22}$ and $R_{26}$ represent a substituting group having sulfo at the same time;

when $Z_{21}$ represents oxygen, $V_{21}$ represents hydrogen;

when $Z_{21}$ represents sulfur or selenium, $V_{21}$ represents hydrogen, or an alkyl or alkoxy, each having five carbon atoms or less;

when $Z_{21}$ represents N-$R_{26}$, $V_{21}$ represents hydrogen or chlorine;

when $Z_{21}$ represents oxygen and $Z_{22}$ represents N-$R_{27}$, $V_{22}$ represents hydrogen, alkyl or alkoxy, each having five carbon atoms or less, chlorine, or substituted or unsubstituted phenyl, that $V_{22}$ can be coupled to $V_{21}$ or $V_{23}$ to form a condensed benzene ring;

when $Z_{21}$ and $Z_{22}$ both represent oxygen, $V_{22}$ represents substituted or unsubstituted phenyl or represents that $V_{22}$ can be coupled to $V_{21}$ or $V_{23}$ to form a condensed benzene ring;

when $Z_{21}$ represents sulfur or selenium, $V_{22}$ represents hydrogen, alkyl or alkoxycarbonyl, each having five carbon atoms or less, alkoxy or acylamino, each having four carbon atoms or less, chlorine, or substituted or unsubstituted phenyl or that $V_{22}$ can be coupled to $V_{23}$ to form a condensed benzene ring;

when $Z_{21}$ represents N-$R_{26}$, $V_{22}$ represents chlorine, trifluoromethyl, cyano, alkylsulfonyl having four carbon atoms or less, or alkoxycarbonyl having five carbon atoms or less;

$V_{23}$ represents hydrogen;

$V_{24}$ represents the same meaning as that represented by $V_{21}$ when $Z_{22}$ represents an atom type corresponding to that represented by $Z_{21}$;

when $Z_{22}$ represents oxygen, $V_{25}$ represents alkoxy having four carbon atoms or less, chlorine, or substituted or unsubstituted phenyl, or represents that $V_{25}$ can be coupled to $V_{24}$ or $V_{26}$ to form a condensed benzene ring;

when $Z_{22}$ represents N-$R_{26}$, $V_{25}$ represents the same meaning as that represented by $V_{22}$ when $Z_{21}$ represents N-$R_{26}$;

when $Z_{22}$ represents sulfur or selenium, $V_{25}$ represents the same meaning as that represented by $V_{22}$ when $Z_{21}$ represents sulfur or sulfur or selenium;

$V_{26}$ represents hydrogen;

$X^-_{21}$ represents an anion residue of an acid;

$m_{21}$ represents 0 or 1; and $n_{21}$ represents 1, 2, or 3;

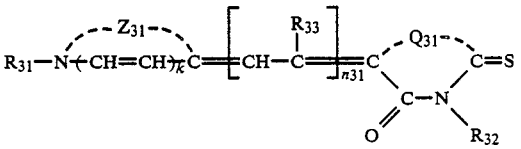

wherein $Z_{31}$ *represents an atom group required for forming substituted or unsubstituted nuclei of thiazoline, thiazole, benzothiazole, naphtholthiazole, selenazoline, selenazole, benzoselenazole, naphthoselenzaole, benzimdazole, naphthoimidazole, oxazole, benzolazole, naphthooxazole, or pyridine;*

$R_{31}$ represents the same meaning as that represented by $R_{11}$ or $R_{12}$ of formula (XXa), $R_{32}$ represents the same meaning as that represented by $R_{11}$ or $R_{12}$ of formula (XXa), and also represents hydrogen, furfuryl, or moncyclic aryl, and also represents that at least one of $R_{31}$ and $R_{32}$ is a substituting group having sulfo or carboxyl and the other is a group not containing sulfo; $R_{33}$ represents hydrogen, alkyl having five carbon atoms or less, phenethyl, phenyl, 2-carboxyphenyl, and when n represents 2 or 3, also represents that different $R_{33}$ and $R_{33}$ can be coupled to form a 5- or 6-membered ring;

$Q_{31}$ represents oxygen, sulfur, selenium, or N-$R_{34}$, $R_{34}$ represents hydrogen, pyridil, phenyl, substituted phenyl or an aliphatic hydrocarbon group having eight carbon atoms or less which may contain oxygen, sulfur, or nitrogen in a carbon chain; or can contain a substituting group;

k represents 0 or 1; and $n_{31}$ represents 0, 1, 2, or 3.

2. The material as in claim 1, wherein said emulsion layer contains a silver halide emulsion comprising silver halide grains consisting of at least 95 mol % of silver chloride and gold-sensitized in the presence of at least one of the compounds represented by formulas [I] to [III].

3. The material as in claim 1, wherein said emulsion contains a silver halide emulsion comprising silver grains consisting of at least 95 mol % of silver chloride and gold-plus-sulfur sensitized in the presence of at least one of the compounds represented by formulas [I] to [III].

4. The material as in claim 1, containing at least one yellow coupler, at least one magenta coupler, and at least one cyan coupler.

5. The material as in claim 1, comprising at least one blue-sensitive silver halide emulsion layer containing an yellow coupler, at least one green-sensitive silver halide emulsion layer containing a magenta coupler, and at least one red-sensitive silver halide emulsion layer containing a cyan coupler.

* * * * *